US008846589B2

(12) United States Patent
Matsuoka et al.

(10) Patent No.: US 8,846,589 B2
(45) Date of Patent: Sep. 30, 2014

(54) LUBRICATING OIL COMPOSITION FOR TRANSMISSION

(75) Inventors: Toru Matsuoka, Yokohama (JP); Masaaki Itou, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 1224 days.

(21) Appl. No.: 11/737,339

(22) Filed: Apr. 19, 2007

(65) Prior Publication Data

US 2007/0191239 A1 Aug. 16, 2007

Related U.S. Application Data

(63) Continuation of application No. PCT/JP2005/019644, filed on Oct. 19, 2005.

(30) Foreign Application Priority Data

Oct. 22, 2004 (JP) ..... 2004-308828
Oct. 22, 2004 (JP) ..... 2004-308829
Oct. 22, 2004 (JP) ..... 2004-308830
Oct. 22, 2004 (JP) ..... 2004-308831

(51) Int. Cl.
*C10M 169/04* (2006.01)
*C10M 133/56* (2006.01)
*C10M 145/14* (2006.01)
*C10M 171/02* (2006.01)

(52) U.S. Cl.
CPC ..... *C10M 171/02* (2013.01); *C10M 2219/046* (2013.01); *C10M 2215/28* (2013.01); *C10N 2230/02* (2013.01); *C10N 2240/04* (2013.01); *C10N 2230/10* (2013.01); *C10N 2230/08* (2013.01); *C10M 2209/084* (2013.01); *C10M 2217/022* (2013.01); *C10M 2215/086* (2013.01); *C10N 2220/022* (2013.01); *C10N 2230/76* (2013.01); *C10M 2205/0285* (2013.01); *C10M 169/041* (2013.01); *C10M 145/14* (2013.01); *C10M 169/04* (2013.01); *C10N 2220/021* (2013.01); *C10N 2240/042* (2013.01); *C10N 2230/06* (2013.01); *C10N 2240/044* (2013.01); *C10M 2203/1025* (2013.01); *C10M 2205/028* (2013.01); *C10M 2217/028* (2013.01); *C10M 2203/1006* (2013.01); *C10N 2240/045* (2013.01); *C10M 2223/049* (2013.01)
USPC ..... 508/225; 508/469; 508/291

(58) Field of Classification Search
USPC ..... 508/225
See application file for complete search history.

(56) References Cited

U.S. PATENT DOCUMENTS 5,188,770 A 2/1993 Pennewiss
5,391,307 A 2/1995 Yamazaki et al.
5,641,732 A 6/1997 Bloch et al.
5,688,748 A 11/1997 Tomizawa
5,744,430 A 4/1998 Inoue et al.
5,969,068 A 10/1999 Bryant et al.
6,133,210 A 10/2000 Tipton
6,225,266 B1 5/2001 Watts et al.
6,329,328 B1 12/2001 Koganei et al.
6,613,722 B1 * 9/2003 Watts et al. ..... 508/195
2001/0027169 A1 10/2001 Kurihara et al.
2001/0044389 A1 11/2001 Komiya et al.
2002/0072478 A1 6/2002 Ishida et al.
2003/0104955 A1 * 6/2003 Yuki et al. ..... 508/469
2003/0162673 A1 * 8/2003 Kurihara et al. ..... 508/469
2004/0043910 A1 * 3/2004 Lok et al. ..... 508/575
2004/0176256 A1 9/2004 Kurosawa et al.
2004/0192562 A1 9/2004 Morita
2006/0105921 A1 5/2006 Arimoto et al.
2006/0135378 A1 * 6/2006 Takahashi et al. ..... 508/433
2009/0131291 A1 5/2009 Kurosawa et al.

FOREIGN PATENT DOCUMENTS

EP 0418610 A1 3/1991
EP 1559772 A1 8/2005
JP 3-039399 A 2/1991
JP 07-268375 A 10/1995
JP 9-3131 A 1/1997
JP 11-181464 A 7/1999
JP 2000-063869 A 2/2000
JP 2000-087070 A 3/2000
JP 2001-181664 A 7/2001
JP 2001-262176 A 9/2001
JP 2002-003876 A 1/2002
JP 2002-012884 A 1/2002
JP 2002-220597 A 8/2002
JP 2002-371292 A 12/2002
JP 2004010799 A 1/2004

(Continued)

OTHER PUBLICATIONS

U.S. Office Action issued May 14, 2012 in U.S. Appl. No. 13/103,582.
U.S. Office Action issued Nov. 30, 2012 in U.S. Appl. No. 13/103,582.

(Continued)

*Primary Examiner* — James Goloboy
(74) *Attorney, Agent, or Firm* — Panitch Schwarze Belisario & Nadel LLP

(57) ABSTRACT

Lubricating oil compositions for transmissions comprises (A) a lubricating base oil with a kinematic viscosity at 100° C. adjusted to 1.5 to 6 $mm^2/s$, composed of (A1) a lubricating base oil with a kinematic viscosity at 100° C. of 1.5 $mm^2/s$ or higher and lower than 7 $mm^2/s$ or (A1) the lubricating oil and (A2) a lubricating base oil with a kinematic viscosity at 100° C. of 7 to 50 $mm^2/s$, blended with (B) a poly(meth)acrylate-based additive, so that the composition has a kinematic viscosity at 100° C. of 3 to 8 $mm^2/s$ and a viscosity index of 95 to 200, (A) and (B) fulfill a specific requirement. The compositions achieve long fatigue life though having low viscosity.

11 Claims, No Drawings

(56) References Cited

FOREIGN PATENT DOCUMENTS

| | | | |
|---|---|---|---|
| JP | 2004-155873 | A | 6/2004 |
| JP | 2004-155924 | A | 6/2004 |
| JP | 2004-169025 | A | 6/2004 |
| JP | 2004155873 | A | 6/2004 |
| JP | 2004-307551 | A | 11/2004 |
| JP | 2005-154760 | A | 6/2005 |
| WO | WO 2004074414 | A1 * | 9/2004 |

OTHER PUBLICATIONS

Office Action issued Oct. 17, 2013 in U.S. Appl. No. 12/297,531.
Int'l Search Report issued on Jun. 26, 2007 in Int'l Application No. PCT/JP2007/059005 (English Translation).
U.S. Office Action issued Sep. 7, 2010 in U.S. Appl. No. 12/297,531.
EP Supplementary Search Report issued Nov. 15, 2010 in EP Application No. 07 74 2440.
U.S. Office Action issued May 18, 2011 in U.S. Appl. No. 12/297,531.
U.S. Appl. No. 13/103,582, filed May 9, 2011.

* cited by examiner

LUBRICATING OIL COMPOSITION FOR TRANSMISSION

CROSS-REFERENCE TO RELATED APPLICATION

This application is a continuation of International Application No. PCT/JP2005/019644, filed Oct. 19, 2005, which was published in the Japanese language on Apr. 27, 2006, under International Publication No. 2006/043709, the disclosure of which is incorporated herein by reference.

FIELD OF THE INVENTION

The present invention relates to lubricating oil compositions for transmissions and more particularly to those suitable for automatic, manual and continuously variable transmissions of automobiles, which compositions have a long fatigue life, though low viscosity, excellent low temperature viscosity characteristics and oxidation stability, and can be extended in anti-shudder durability.

BACKGROUND OF THE INVENTION

In recent years, from the viewpoint of approaching to environmental issues such as reduction of carbon dioxide emission, there has arisen an urgent need that automobiles, construction machines and agricultural machines consume less energy, i.e., are reduced in the fuel-consumption thereof. In particular, there is a growing demand that their units such as engines, transmissions, final reduction gear units, compressors and hydraulic equipment contribute to energy saving. Therefore, the lubricating oils used in these units are demanded to be less in frictional loss by agitation and frictional resistance than ever before.

Lowering the viscosity of a lubricating oil may be an example as a means for improving the fuel economy by a transmission and a final reduction gear unit. For example, an automobile automatic transmission or continuously variable transmission has a torque converter, a wet clutch, a gear bearing mechanism, an oil pump and a hydraulic control system while a manual transmission or final reduction gear unit has a gear bearing mechanism. Lowering the viscosity of the lubricating oil to be used in such transmissions can reduce the stirring and frictional resistances of the torque converter, wet clutch, gear bearing mechanism and oil pump and thus enhance the power transmission efficiency thereof, resulting in an improvement in the fuel economy performance of the automobile.

However, lowering the viscosity of the lubricating oil used in these transmissions causes the above-described units and mechanisms thereof to be significantly shortened in fatigue life and may generate seizure resulting in some malfunctions in the transmissions. In particular when a low viscosity lubricating oil is blended with a phosphorus-based extreme pressure additive to enhance the extreme pressure properties, the fatigue life will be extremely shortened. Therefore, it is generally difficult to lower the viscosity of the lubricating oil. It is generally known that although a sulfur-based extreme pressure additive can improve the fatigue life of transmissions, the viscosity of the base oil gives a more effect on the fatigue life than additives under low lubricating conditions.

Examples of conventional automobile transmission oils which can render a transmission capable of maintaining various properties such as shifting properties for a long time include those obtained by optimizing and blending synthetic and/or mineral base oils, antiwear agents, extreme pressure additives, metallic detergents, ashless dispersants, friction modifiers and viscosity index improvers (for example, see Patent Documents 1 to 4 below). However, these compositions are not aimed at improving the fuel economy performance of an automobile and thus are high in kinematic viscosity. Any of the publications does not refer to effects on the fatigue life obtained by lowering the viscosity of the lubricating oils at all. Therefore, a composition which can solve the foregoing problems has not been sufficiently studied yet.

(1) Japanese Patent Laid-Open Publication No. 3-39399
(2) Japanese Patent Laid-Open Publication No. 7-268375
(3) Japanese Patent Laid-Open Publication No. 2000-63869
(4) Japanese Patent Laid-Open Publication No. 2001-262176

DISCLOSURE OF THE INVENTION

The present invention was made in view of the foregoing situations and intends to provide a lubricating oil for transmissions which is low in viscosity but capable of providing a long fatigue life and excellent in low temperature viscosity characteristics and oxidation stability, and can be extended in anti-shudder durability, and in particular such a lubricating oil composition having fuel efficient performance and sufficient durability for gears and bearings, suitable for the automatic, manual or continuously variable transmission of an automobile.

As a result of an extensive study and research conducted for solving the above-described problems, focusing on lubricating base oils and polymers, the present invention was achieved on the basis of the finding that the above problems were able to be solved with a lubricating oil composition for transmissions which was lowered in viscosity by selecting a specific base oil and a specific poly(meth)acrylate-based additive.

That is, according to the present invention, there is provided a lubricating oil composition for transmissions, comprising (A) a lubricating base oil with a kinematic viscosity at 100° C. adjusted to 1.5 to 6 $mm^2/s$, composed of (A1) a lubricating base oil with a kinematic viscosity at 100° C. of 1.5 $mm^2/s$ or higher and lower than 7 $mm^2/s$ or (A1) the lubricating oil and (A2) a lubricating base oil with a kinematic viscosity at 100° C. of 7 to 50 $mm^2/s$, blended with (B) a poly(meth)acrylate-based additive containing a structural unit represented by formula (1) below, so that the composition has a kinematic viscosity at 100° C. of 3 to 8 $mm^2/s$ and a viscosity index of 95 to 200, the composition fulfilling at least one requirement selected from the following [I] to [III]:

[I] Component (A) is a lubricating base oil having a kinematic viscosity at 100° C. adjusted to 1.5 to 4.5 $mm^2/s$ and Component (B) is (B1) a poly(meth)acrylate-based additive containing a structural unit of formula (1) wherein $R_2$ is a straight-chain or branched hydrocarbon group having 16 to 30 carbon atoms;

[II] Component (A) is a lubricating base oil with a kinematic viscosity at 100° C. adjusted to 1.5 to 6 $mm^2/s$, composed of 70 to 97 percent by mass of Component (A1) and 3 to 30 percent by mass of Component (A2), and Component (B) is (B2) a poly(meth)acrylate-based additive substantially not containing a structural unit of formula (1) wherein $R_2$ is a hydrocarbon group having 20 or more carbon atoms; and

[III] the kinematic viscosity at 100° C. (Vc) of the composition is from 4.5 to 8 $mm^2/s$, and the ratio of the kinematic viscosity at 100° C. (Vb) of Component (A) to (Vc) (=Vb/Vc) is 0.70 or greater, (1)

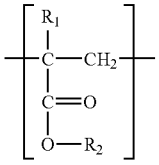

wherein $R_1$ is hydrogen or methyl, $R_2$ is a hydrocarbon group having 1 to 30 carbon atoms or a group represented by —$(R)_a$-E wherein R is an alkylene group having 1 to 30 carbon atoms, E is an amine residue or a heterocyclic residue, each having 1 or 2 nitrogen atoms and 0 to 2 oxygen atoms, and a is an integer of 0 or 1.

The present invention will be described below.

The lubricating base oil (A) used in the present invention is a lubricating base oil with a kinematic viscosity at 100° C. adjusted to 1.5 to 6 $mm^2/s$, composed of (A1) a lubricating base oil with a kinematic viscosity at 100° C. of 1.5 $mm^2/s$ or higher and lower than 7 $mm^2/s$ or composed of (A1) the lubricating base oil and (A2) a lubricating base oil with a kinematic viscosity at 100° C. of 7 to 50 $mm^2/s$ and may be a mineral lubricating base oil, a synthetic lubricating base oil or a mixture thereof.

Examples of mineral lubricating base oils include paraffinic or naphthenic oils which can be obtained by subjecting a lubricating oil fraction produced by atmospheric- or vacuum-distillation of a crude oil, to any one of or any suitable combination of refining processes selected from solvent deasphalting, solvent extraction, hydrocracking, solvent dewaxing, catalytic dewaxing, hydrorefining, sulfuric acid treatment, and clay treatment; n-paraffins; and iso-paraffins. These base oils may be used alone or in combination at an arbitrary ratio.

Examples of preferred mineral lubricating base oils include the following base oils:

(1) a distillate oil produced by atmospheric distillation of a paraffin base crude oil and/or a mixed base crude oil;

(2) a whole vacuum gas oil (WVGO) produced by vacuum distillation of the topped crude of a paraffin base crude oil and/or a mixed base crude oil;

(3) a wax obtained by a lubricating oil dewaxing process and/or a Fischer-Tropsch wax produced by a GTL process;

(4) an oil obtained by mild-hydrocracking (MHC) one or more oils selected from oils of (1) to (3) above;

(5) a mixed oil of two or more oils selected from (1) to (4) above;

(6) a deasphalted oil (DAO) obtained by deasphalting an oil of (1), (2) (3), (4) or (5);

(7) an oil obtained by mild-hydrocracking (MHC) an oil of (6); and (8) a lubricating oil obtained by subjecting a mixed oil of two or more oils selected from (1) to (7) used as a feed stock and/or a lubricating oil fraction recovered therefrom to a normal refining process and further recovering a lubricating oil fraction from the refined product.

There is no particular restriction on the normal refining process used herein. Therefore, there may be used any refining process conventionally used upon production of a lubricating base oil. Examples of the normal refining process include (a) hydro-refining processes such as hydrocracking and hydrofinishing, (b) solvent refining such as furfural extraction, (c) dewaxing such as solvent dewaxing and catalytic dewaxing, (d) clay refining with acidic clay or active clay and (e) chemical (acid or alkali) refining such as sulfuric acid treatment and sodium hydroxide treatment. In the present invention, any one or more of these refining processes may be used in any order.

The mineral lubricating base oil used in the present invention is particularly preferably a base oil obtained by further subjecting a base oil selected from (1) to (8) described above to the following treatments.

That is, preferred are a hydrocracked mineral oil and/or wax-isomerized isoparaffin base oil obtained by hydrocracking or wax-isomerizing a base oil selected from (1) to (8) described above as it is or a lubricating fraction recovered therefrom and subjecting the resulting product as it is or a lubricating fraction recovered therefrom to dewaxing such as solvent dewaxing or catalytic dewaxing, followed by solvent refining or followed by solvent refining and then dewaxing such as solvent dewaxing or catalytic dewaxing. The hydrocracked mineral oil and/or wax-isomerized isoparaffin base oil are used in an amount of preferably 30 percent by mass or more, more preferably 50 percent by mass or more, and particularly preferably 70 percent by mass or more, on the basis of the total amount of the base oil.

Examples of synthetic lubricating base oils include poly-α-olefins and hydrogenated compounds thereof; isobutene oligomers and hydrogenated compounds thereof; isoparaffins; alkylbenzenes; alkylnaphthalenes; diesters such as ditridecyl glutarate, di-2-ethylhexyl adipate, diisodecyl adipate, ditridecyl adipate and di-2-ethylhexyl s-ebacate; polyol esters such as trimethylolpropane caprylate, trimethylolpropane pelargonate, pentaerythritol 2-ethylhexanoate and pentaerythritol pelargonate; polyoxyalkylene glycols; dialkyldiphenyl ethers; and polyphenyl ethers.

Preferred synthetic lubricating base oils are poly-α-olefins. Typical examples of poly-α-olefins include oligomers or cooligomers of α-olefins having 2 to 32 and preferably 6 to 16 carbon atoms, such as 1-octene oligomer, 1-decene oligomer, ethylene-propylene cooligomer, and hydrogenated compounds thereof.

There is no particular restriction on the method of producing poly-α-olefins. For example, poly-α-olefins may be produced by polymerizing α-olefins in the presence of a polymerization catalyst such as a Friedel-Crafts catalyst containing aluminum trichloride, boron trifluoride or a complex of boron trifluoride with water, an alcohol such as ethanol, propanol and butanol, a carboxylic acid or an ester such as ethyl acetate and ethyl propionate.

The lubricating base oil (A) used in the present invention may be a mixture of two or more types of mineral base oils or two or more types of synthetic base oils or a mixture of mineral base oils and synthetic base oils. The mix ratio of two or more base oils in such mixtures may be arbitrarily selected.

The lubricating base oil (A) used in the present invention is a lubricating base oil with a kinematic viscosity at 100° C. adjusted to 1.5 to 6 $mm^2/s$, composed of (A1) a lubricating base oil with a kinematic viscosity at 100° C. of 1.5 $mm^2/s$ or higher and lower than 7 $mm^2/s$ or composed of (A1) the lubricating base oil and (A2) a lubricating base oil with a kinematic viscosity at 100° C. of 7 to 50 $mm^2/s$.

Component (A1) is preferably one or more types selected from the following (A1a) to (A1c):

(A1a) a mineral base oil with a kinematic viscosity at 100° C. of 1.5 $mm^2/s$ or higher and lower than 3.5 $mm^2/s$ and preferably from 1.9 to 3.2 $mm^2/s$;

(A1b) a mineral base oil with a kinematic viscosity at 100° C. of 3.5 $mm^2/s$ or higher and lower than 7 $mm^2/s$ and preferably from 3.8 to 4.5 $mm^2/s$; and (A1c) a poly-α-olefin base oil with a kinematic viscosity at 100° C. of 1.5 $mm^2/s$ or higher and lower than 7 $mm^2/s$ and preferably from 3.8 to 4.5 $mm^2/s$.

There is no particular restriction on the % $C_A$ of the lubrication base oils (A1a) to (A1c). However, the % $C_A$ is preferably 3 or less, more preferably 2 or less, particularly preferably 1 or less. Component (A) with a % $C_A$ of 3 or less renders it possible to produce a composition with more excellent oxidation stability.

The term "% $C_A$" denotes a percentage of aromatic carbon number to total carbon number, determined by a method prescribed in ASTM D 3238-85.

There is no particular restriction on the viscosity index of the lubrication base oils (A1a) to (A1c). However, the viscosity index is preferably 80 or greater, more preferably 90 or greater, particularly preferably 110 or greater and usually 200 or less and preferably 160 or less. The use of a lubricating base oil with a viscosity index of 80 or greater renders it possible to produce a composition with excellent viscosity characteristics from low temperatures to high temperatures. The use of a lubricating base oil with a too high viscosity index is less effective to fatigue life.

There is no particular restriction on the sulfur content of the lubrication base oils (A1a) to (A1c). However, the sulfur content is preferably 0.05 percent by mass or less, more preferably 0.02 percent by mass or less, and particularly preferably 0.005 percent by mass or less. Reduction of the sulfur content of Component (A) renders it possible to obtain a composition with excellent oxidation stability.

The lubricating base oils (A1a) to (A1c) may be used alone or may be arbitrarily mixed. In particular, it is preferable to use (A1a) and (A1b) and/or (A1c) in combination. When (A1a) and/or (A1b) and (A1c) are used in combination, the content of (A1c) is preferably from 1 to 50 percent by mass, more preferably from 3 to 20 percent by mass, and more preferably from 3 to 10 percent by mass, on the basis of the total amount of the base oil. In particular, when Component (A1) is used in combination with Component (A2) described below, blend of 3 to 8 percent by mass of Component (A1c) renders it possible to produce a lubricating oil composition which can exhibit excellent fatigue life, low temperature characteristics and oxidation stability, effectively at a low cost.

The lubricating base oil (A) used in the present invention preferably comprises the above-described (A1) and (A2) a lubricating base oil with a kinematic viscosity at 100° C. of 7 to 50 $mm^2/s$.

Component (A2) is preferably one or more types selected from the following (A2a) to (A2c):

(A2a) a mineral or synthetic, preferably mineral base oil with a kinematic viscosity at 100° C. of 7 $mm^2/s$ or higher and lower than 15 $mm^2/s$ and preferably from 8 to 12 $mm^2/s$;

(A2b) a mineral or synthetic, preferably mineral base oil with a kinematic viscosity at 100° C. of 15 $mm^2/s$ or higher and lower than 25 $mm^2/s$ and preferably from 17 to 23 $mm^2/s$; and (A2c) a mineral or synthetic, preferably mineral base oil with a kinematic viscosity at 100° C. of 25 to 50 $mm^2/s$ and preferably from 28 to 40 $mm^2/s$.

The % $C_A$ of the lubrication base oils (A2a) to (A2c) is usually from 0 to 40 and thus is not particularly restricted. However, the % $C_A$ is preferably 2 or greater, more preferably 5 or greater, particularly preferably 8 or greater and preferably 15 or less, more preferably 10 or less because the resulting composition can have both fatigue life and oxidation stability.

There is no particular restriction on the viscosity index of the lubrication base oils (A2a) to (A2c). However, the viscosity index is preferably 80 or greater, more preferably 90 or greater, particularly preferably 95 or greater and usually 200 or less, preferably 120 or less, more preferably 110 or less, and particularly preferably 100 or less. The use of a lubricating base oil with a viscosity index of 80 or greater renders it possible to produce a composition with excellent viscosity characteristics from low temperatures to high temperatures. The use of a lubricating base oil with a too high viscosity index is less effective to fatigue life.

There is no particular restriction on the sulfur content of the lubricating base oils (A2a) to (A2c). However, the sulfur content is usually from 0 to 2 percent by mass, preferably from 0.05 to 1.5 percent by mass, more preferably 0.3 to 1.2 percent by mass, more preferably 0.5 to 1 percent by mass, and particularly preferably 0.7 to 1 percent by mass. The use of Component (A2) with a relatively high sulfur content can enhance fatigue life while the use of Component (A2) with a sulfur content of preferably 1 percent by mass or less renders it possible to obtain a composition with more excellent oxidation stability.

When Component (A2) is used in the present invention, it is preferable to use (A2b) or (A2c) with the objective of improving fatigue life and particularly preferable to use (A2b) with the objective of improving both fatigue life and oxidation stability. The use of (A1C) as Component (A1) renders it possible to obtain a composition excellent in fatigue life, oxidation stability and low temperature viscosity.

There is no particular restriction on the contents of Components (A1) and (A2) when used in combination. The content of Component (A1) is preferably from 70 to 97 percent by mass and more preferably from 85 to 95 percent by mass, on the basis of the total amount of the lubricating base oil. The content of Component (A2) is preferably from 3 to 30 percent by mass and more preferably from 5 to 15 percent by mass, on the basis of the total amount of the lubricating base oil.

As described above, the lubricating base oil (A) used in the present invention is a lubricating base oil composed of Component (A1) or Components (A1) and (A2). The kinematic viscosity at 100° C. of (A) the base oil is from 1.5 to 6 $mm^2/s$, preferably from 2.8 to 4.5 $mm^2/s$, and particularly preferably from 3.6 to 3.9 $mm^2/s$. The use of a lubricating base oil with a kinematic viscosity at 100° C. of 6 $mm^2/s$ or less renders it possible to obtain a lubricating oil composition with a small friction resistance at lubricating sites because its fluid resistance is small and thus with excellent low temperature viscosity. The use of a lubricating base oil with a kinematic viscosity at 100° C. of 1.5 $mm^2/s$ or higher renders it possible to produce a lubricating oil composition which is sufficient in oil film formation leading to excellent lubricity and less in evaporation loss of the base oil under elevated temperature conditions.

There is no particular restriction on the % $C_A$ of the lubricating base oil (A). However, the % $C_A$ is preferably 3 or less, more preferably 2 or less, particularly preferably 1 or less. The use of Component (A) with a % $C_A$ of 3 or less renders it possible to produce a composition with more excellent oxidation stability.

There is no particular restriction on the sulfur content of the lubricating base oil (A). However, the sulfur content is usually from 0 to 0.3 percent by mass, preferably from 0.03 to 0.2 percent by mass, and particularly preferably 0.06 to 0.1 percent by mass. The use of a lubricating base oil with a sulfur content within the above ranges, particularly from 0.03 to 0.2 percent by mass renders it possible to obtain a lubricating oil composition having both fatigue life and oxidation stability.

Component (B) is a poly(meth)acrylate-based additive containing a structural unit represented by formula (1) below and may be a non-dispersion type poly(meth)acrylate additive having no polar group or a dispersion type poly(meth) acrylate additive having a polar group:

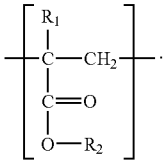

(1)

In formula (1), $R_1$ is hydrogen or methyl, $R_2$ is a hydrocarbon group having 1 to 30 carbon atoms or a group represented by $—(R)_a$-E wherein R is an alkylene group having 1 to 30 carbon atoms, E is an amine residue or a heterocyclic residue, each having 1 or 2 nitrogen atoms and 0 to 2 oxygen atoms, and a is an integer of 0 or 1.

Examples of hydrocarbon groups having 1 to 30 carbon atoms for $R_2$ include straight-chain or branched alkyl groups, such as such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; and straight-chain or branched alkenyl groups such as propenyl, butenyl, pentenyl, hexenyl, heptenyl, octenyl, noneyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl, and tiraconetenyl groups, the position of which the double bonds may vary.

Examples of alkylene groups having 1 to 30 carbon atoms for R include methylene, ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene groups, all of which may be straight-chain or branched.

When E is an amine residue, specific examples thereof include dimethylamino, diethylamino, dipropylamino, dibutylamino, anilino, toluidino, xylidino, acetylamino, and benzoilamino groups. When E is a heterocyclic residue, specific examples thereof include morpholino, pyrrolyl, pyrrolino, pyridyl, methylpyridyl, pyrolidinyl, piperidinyl, quinonyl, pyrrolidonyl, pyrrolidono, imidazolino and pyrazino groups.

Component (B), i.e., the poly(meth)acrylate containing a structural unit represented by formula (1) may be a poly (meth)acrylate obtained by polymerizing or copolymerizing one or more types of monomers represented by formula (1') or may be a copolymer of one or more types of monomers represented by formula (1') and monomers other than those represented by formula (1'):

$$CH_2{=}C(R_1){-}C({=}O){-}OR_2 \quad (1')$$

wherein $R_1$ and $R_2$ are the same as those in formula (1).

Specific examples of monomers represented by formula (1') are the following monomers (Ba) to (Be):

(Ba) (meth)acrylates having an alkyl group having 1 to 4 carbon atoms, such as methyl(meth)acrylate, ethyl(meth) acrylate, n- or i-propyl(meth)acrylate, and n-, i- or sec-butyl (meth)acrylate, preferably methyl(meth)acrylate;

(Bb) (meth)acrylates having an alkyl or alkenyl group having 5 to 15 carbon atoms, such as pentyl(meth)acrylate, hexyl (meth)acrylate, heptyl(meth)acrylate, octyl(meth)acrylate, nonyl(meth)acrylate, decyl(meth)acrylate, undecyl(meth) acrylate, dodecyl(meth)acrylate, tridecyl(meth)acrylate, tetradecyl(meth)acrylate, and pentadecyl(meth)acrylate (all of which may be straight-chain or branched), and cctenyl(meth) acrylate, noneyl(meth)acrylate, decenyl(meth)acrylate, undecenyl(meth)acrylate, dodecenyl(meth)acrylate, tridecenyl(meth)acrylate, tetradecenyl(meth)acrylate, and pentadecenyl(meth)acrylate (all of which may be straight-chain or branched), preferably (meth)acrylates having an alkyl group having 12 to 15 carbon atoms as the main component;

(Bc) (meth)acrylates having an alkyl or alkenyl group having 16 to 30 carbon atoms, preferably a straight-chain alkyl group having 16 to 20 carbon atoms and a straight-chain alkyl group having 16 or 18 carbon atoms, specifically n-hexadecyl (meth)acrylate, n-octadecyl(meth)acrylate, n-eicosyl(meth) acrylate, n-docosyl(meth)acrylate, n-tetracosyl(meth)acrylate, n-hexacosyl(meth)acrylate, and n-octacosyl(meth) acrylate, and particularly preferably n-hexadecyl(meth) acrylate and n-octadecyl(meth)acrylate;

(Bd) (meth)acrylates having a branched alkyl or alkenyl group having 16 to 30 carbon atoms, preferably a branched alkyl group having 20 to 28 carbon atoms and more preferably a branched alkyl group having 22 to 26 carbon atoms, specifically branched hexadecyl(meth)acrylate, branched octadecyl(meth)acrylate, branched eicosyl(meth)acrylate, branched docosyl(meth)acrylate, branched tetracosyl(meth) acrylate, branched hexacosyl(meth)acrylate, and branched octacosyl(meth)acrylate, preferably (meth)acrylate having a branched alkyl group having 16 to 30 carbon atoms, preferably 20 to 28 carbon atoms and more preferably 22 to 26 carbon atoms, as represented by $—C—C(R_3)R_4$ wherein there is no particular restriction on $R_3$ or $R_4$ as long as the carbon number of $R_2$ is from 16 to 30, but $R_3$ is a straight-chain alkyl group having preferably 6 to 12 and more preferably 10 to 12 carbon atoms, and $R_4$ is a straight-chain alkyl group having preferably 10 to 16 carbon atoms and more preferably 14 to 16 carbon atoms, more specifically (meth) acrylates having a branched alkyl group having 20 to 30 carbon atoms, such as 2-decyl-tetradecyl(meth)acrylate, 2-dodecyl-hexadecyl(meth)acrylate, and 2-decyl-tetradecyloxyethyl(meth)acrylate;

(Be) polar group-containing monomers such as amide group-containing monomers, nitro group-containing monomers, primary to quaternary amino group-containing vinyl monomers, nitrogen-containing heterocyclic vinyl monomers, hydrochlorides thereof, sulfates thereof, phosphates thereof, lower alkyl($C_1$ to $C_8$)monocarboxylic acid salts thereof, quaternary ammonium base-containing vinyl monomers, amphoteric vinyl monomers containing oxygen or nitrogen, nitrile group-containing monomers, aliphatic hydrocarbon-based vinyl monomers, alicyclic hydrocarbon-based vinyl monomers, aromatic hydrocarbon-based vinyl monomers, vinyl ester, vinyl ether, vinyl ketones, epoxy group-containing vinyl monomers, halogen atom-containing vinyl monomers, esters of unsaturated polycarboxylic acids, hydroxyl group-containing vinyl monomers, polyoxyalkylene chain-containing vinyl monomers, and ionic group-containing vinyl monomers (anionic group-, phosphoric acid group-, sulfonic acid group- or sulfuric acid ester group-containing vinyl monomers) univalent metal salts thereof, divalent metal salts thereof, amine salts thereof and ammonium salts thereof, more specifically and preferably nitrogen-containing monomers such as 4-diphenylamine (meth)acrylamide, 2-diphenylamine (meth)acrylamide, dimethylaminoethyl (meth)acryl amide, diethylaminoethyl (meth)acrylamide, dimethylaminopropyl (meth)acrylamide, dimethylaminomethyl methacrylate, diethylaminomethyl methacrylate, dimethylaminoethyl (meth)acrylate, diethylaminoethyl (meth)acrylate, morpholinomethyl methacrylate, morpholinoethyl methacrylate, 2-vinyl-5-methylpyridine and N-vinylpyrrolidone.

Component (B) used in the present invention is a poly (meth)acrylate-based compound obtained by polymerizing or copolymerizing one or more monomers selected from the above-described (Ba) to (Be), and more preferable specific examples of the compound include the following compounds:

(1) non-dispersion type poly(meth)acrylates, which are copolymers of (Ba) and (Bb), or hydrogenated compounds thereof;
(2) non-dispersion type poly(meth)acrylates, which are copolymers of (Ba), (Bb) and (Bc), or hydrogenated compounds thereof;
(3) non-dispersion type poly(meth)acrylates, which are copolymers of (Ba), (Bb), (Bc) and (Bd), or hydrogenated compounds thereof;
(4) dispersion type poly(meth)acrylates, which are copolymers of (Ba), (Bb) and (Be), or hydrogenated compounds thereof;
(5) dispersion type poly(meth)acrylates, which are copolymers of (Ba), (Bb), (Bc) and (Be), or hydrogenated compounds thereof; and
(6) dispersion type poly(meth)acrylates, which are copolymers of (Ba), (Bb), (Bc), (Bd) and (Be), or hydrogenated compounds thereof. Preferred are non-dispersion type poly (meth)acrylates (1) to (3) and particularly preferred are non-dispersion type poly(meth)acrylates (3).

The content of Component (B), i.e., poly(meth)acrylate-based additive in the transmission lubricating oil composition of the present invention is to be such that the kinematic viscosity at 100° C. of the composition is from 3 to 8 $mm^2/s$, preferably from 4.5 to 6 $mm^2/s$, and the viscosity index of the composition is from 95 to 200, preferably from 120 to 190, and more preferably from 150 to 180. The content of Component (B) is usually from 0.1 to 15 percent by mass, preferably from 2 to 12 percent by mass and particularly preferably from 3 to 8 percent by mass on the basis of the total mass of the composition. The content of Component (B) may be a content thereof containing or not containing a diluent as long as it falls within the above-prescribed ranges. High molecular weight polymers for lubricating oil are usually used in a state wherein it is diluted to 10 to 80 percent by mass with a diluent, in consideration of handling and dissolubility in a lubricating base oil. Therefore, the above-described content is a preferable content of Component (B) when it contains a diluent. The content of Component (B) in excess of the prescribed range of the composition is not preferable because the resulting composition not only fails to be improved in an effect of improving fatigue life as balanced with the content but also is poor in shear stability and hard to retain the initial extreme pressure properties for a long period of time.

The lubricating oil composition of the present invention comprises Component (A) blended with Component (B) so that the composition has a kinematic viscosity at 100° C. of 3 to 8 $mm^2/s$ and a viscosity index of 95 to 200, the composition fulfilling at least one requirement selected from the following [I] to [III]:

[I] Component (A) is a base oil having a kinematic viscosity at 100° C. adjusted to 1.5 to 4.5 $mm^2/s$ and Component (B) is (B1) a poly(meth)acrylate containing a structural unit of formula (1) wherein $R_2$ is a straight-chain or branched hydrocarbon group having 16 to 30 carbon atoms;
[II] Component (A) is a lubricating base oil with a kinematic viscosity at 100° C. adjusted to 1.5 to 6 $mm^2/s$, composed of 70 to 97 percent by mass of Component (A1) and 3 to 30 percent by mass of Component (A2), and Component (B) is (B2) a poly(meth)acrylate-based additive substantially not containing a structural unit of formula (1) wherein $R_2$ is a hydrocarbon group having 20 or more carbon atoms; and
[III] the kinematic viscosity at 100° C. (Vc) of the composition is from 4.5 to 8 $mm^2/s$, and the ratio of the kinematic viscosity at 100° C. (Vb) of Component (A) to (Vc) (=Vb/Vc) is 0.70 or greater.

Requirement [I] is now described below.

Requirement [I] is to be such that Component (A) is a base oil having a kinematic viscosity at 100° C. adjusted to 1.5 to 4.5 $mm^2/s$ and Component (B) is (B1) a poly(meth)acrylate containing a structural unit of formula (1) wherein $R_2$ is a straight-chain or branched hydrocarbon group having 16 to 30 carbon atoms.

Component (A) is the above-described Component (A1) or Components (A1) and (A2) and is adjusted in kinematic viscosity at 100° C. to 1.5 to 4.5 $mm^2/s$, preferably 2.8 to 4.0 $mm^2/s$, and particularly preferably 3.6 to 3.9 $mm^2/s$. The kinematic viscosity at 100° C. of 4.5 $mm^2/s$ or lower renders it possible to produce a lubricating oil composition which is small in friction resistance at lubricating sites due to its small fluid resistance and is excellent in low temperature viscosity (for example, a Brookfield viscosity at −40° C. of 20000 mPa·s or lower). The kinematic viscosity at 100° C. of 1.5 $mm^2$/or higher renders it possible to produce a lubricating oil composition which is sufficient in oil film formation, excellent in lubricity, and less in evaporation loss of the base oil at elevated temperatures.

When Component (A) is the combination of Components (A1) and (A2) in Requirement [I], the blend ratio of Component (A1) is from 70 to 97 percent by mass and preferably from 85 to 95 percent by mass while the blend ratio of Component (A2) is from 3 to 30 percent by mass and preferably from 5 to 15 percent by mass. The use of Component (A2) is particularly preferable because the fatigue life can be more enhanced.

Component (B) in Requirement [I] is (B1) a poly(meth) acrylate-based additive containing a structural unit represented by formula (1) wherein $R_2$ is a straight-chain or branched hydrocarbon group having 16 to 30 carbon atoms. Specific examples include poly(meth)acrylate-based additives obtained by (co)polymerizing a monomer containing the above-described Components (Bc) and/or (Bd).

The composition ratio of Components (Bc) and (Bd) of Component (B) used in Requirement [I] is preferably 5 percent by mole or more, more preferably 15 percent by mole or more and particularly preferably 30 percent by mole or more. The composition ratio is preferably 80 percent by mole or less, and more preferably 60 percent by mole or less, and particularly preferably 50 percent by mole or less in view of low temperature viscosity characteristics. More specifically, the composition ratio of the above-described Components (Bc), (Bd), (Ba), (Bb) and (Be) is preferably the following ratio on the basis of the total amount of the monomer constituting the poly(meth)acrylate:

Component (Bc): preferably 5 to 60 percent by mole, more preferably 10 to 40 percent by mole, and particularly preferably 20 to 40 percent by mole;

Component (Bd): preferably 5 to 60 percent by mole, more preferably 10 to 40 percent by mole, and particularly preferably 10 to 30 percent by mole;

Component (Ba): preferably 0 to 90 percent by mole, more preferably 20 to 80 percent by mole, and particularly preferably 30 to 70 percent by mole;

Component (Bb): preferably 0 to 60 percent by mole, more preferably 5 to 30 percent by mole, and particularly preferably 10 to 20 percent by mole; and Component (Be): preferably 0 to 20 percent by mole, more preferably 0 to 10 percent by mole, and particularly preferably 1 to 5 percent by mole.

There is no particular restriction on the weight-average molecular weight of Component (B) used in Requirement [I], which is usually from 5000 to 150000. However, the weight-average molecular weight of Component (B) is preferably from 10000 to 60000, more preferably from 15000 to 60000, more preferably from 15000 to 30000 and particularly preferably from 15000 to 24000 with the objective of improving fatigue life.

The weight-average molecular weight used herein denotes a weight-average molecular weight in terms of polystyrene determined with a differential refractive index detector (RI) at a temperature of 23° C., a flow rate of 1 mL/min, a sample concentration of 1 percent by mass, using 150-C ALC/GPC manufactured by Waters having two columns GMHHR-M (7.8 mm Id×30 cm) equipped in series therein and tetrahydrofuran as a solvent.

Next, Requirement [II] will be described.

Requirement [II] is to be such that Component (A) is a lubricating base oil with a kinematic viscosity at 100° C. adjusted to 1.5 to 6 $mm^2/s$, composed of 70 to 97 percent by mass of Component (A1) and 3 to 30 percent by mass of Component (A2), and Component (B) is (B2) a poly(meth) acrylate-based additive substantially not containing a structural unit of formula (1) wherein $R_2$ is a hydrocarbon group having 20 or more carbon atoms.

That is, Component (A) is composed of Components (A1) and (A2). The blend ratio of Component (A1) is from 70 to 97 percent by mass and preferably from 85 to 95 percent by mass while the blend ratio of Component (A2) is from 3 to 30 percent by mass and preferably from 5 to 15 percent by mass.

Component (B) is (B2) a poly(meth)acrylate-based additive substantially not containing a structural unit of formula (1) wherein $R_2$ is a hydrocarbon group having 20 or more carbon atoms.

There is no particular restriction on Component (B) as long as it contains substantially no structural unit of formula (1) wherein $R_2$ is a hydrocarbon group having 20 or more carbon atoms. Specifically, Component (B) is a poly(meth)acrylate composed of a structural unit of formula (1) wherein $R_1$ is hydrogen or methyl, preferably methyl, $R_2$ is a hydrocarbon group having 1 to 18 carbon atoms or a group represented by $—(R)_a$-E wherein R is an alkylene group having 1 to 18 carbon atoms, E is an amine residue or a heterocyclic residue, each having 1 or 2 nitrogen atoms and 0 to 2 oxygen atoms, and a is an integer of 0 or 1.

Examples of the poly(meth)acrylate-based additive substantially not containing a structural unit of formula (1) wherein $R_2$ is a hydrocarbon group having 20 or more carbon atoms include poly(meth)acrylates obtained by polymerizing or copolymerizing one or more types of monomers represented by formula (2'):

$$CH_2{=}C(R_1)—C({=}O)—OR_2 \quad (2')$$

wherein $R_1$ is hydrogen or methyl, preferably methyl, $R_2$ is a hydrocarbon group having 1 to 18 carbon atoms or a group represented by $—(R)_a$-E wherein R is an alkylene group having 1 to 18 carbon atoms, E is an amine residue or a heterocyclic residue, each having 1 or 2 nitrogen atoms and 0 to 2 oxygen atoms, and a is an integer of 0 or 1.

Specific examples of the monomers represented by formula (2') include the above-described Components (Ba), (Bb), (Be) and the following monomers (Bf):

Component (Bf): (meth)acrylates having an alkyl group having 16 to 18 carbon atoms.

Specific examples of Component (Bf) include hexadecyl (meth)acrylate, heptadecyl(meth)acrylate and octadecyl (meth)acrylate, all of which may be straight-chain or branched. Component (Bf) is preferably a (meth)acrylate having a straight-chain alkyl group having 16 or 18 carbon atoms.

In Requirement [II], Component (B) is a poly(meth)acrylate containing no poly(meth)acrylate derived from a (meth) acrylate monomer having at its side chains a hydrocarbon group having 20 or more carbon atoms, preferably poly (meth)acrylate containing no poly(meth)acrylate derived from a (meth)acrylate monomer having at its side chains a branched hydrocarbon group having 16 or more carbon atoms, more preferably a poly(meth)acrylate obtained by polymerizing a (meth)acrylate monomer containing Components (Ba) and (Bb) as the main components (which may contain slight amount of Components (Be) and/or 'Bf)), and particularly preferably and effectively a poly(meth)acrylate obtained by polymerizing a (meth)acrylate monomer consisting of Components (Ba) and (Bb). The composition ratio of the monomers of Component (B) is the following ratio on the basis of the total amount of the monomers constituting the poly(meth)acrylate:

Component (Ba): preferably 10 to 90 percent by mole, more preferably 20 to 80 percent by mole, and particularly preferably 30 to 70 percent by mole;

Component (Bb): preferably 10 to 90 percent by mole, more preferably 20 to 80 percent by mole, and particularly preferably 30 to 70 percent by mole;

Component (Bf): preferably 0 to 50 percent by mole, more preferably 0 to 20 percent by mole, and particularly preferably 0 to 5 percent by mole;

Component (Be): preferably 0 to 20 percent by mole, more preferably 0 to 10 percent by mole, and particularly preferably 0 to 5 percent by mole.

There is no particular restriction on the weight-average molecular weight of Component (B) used in Requirement [II], which is usually from 5000 to 150000. However, the weight-average molecular weight of Component (B) is preferably from 10000 to 60000, more preferably from 15000 to 60000, more preferably from 15000 to 30000 and particularly preferably from 15000 to 24000 with the objective of improving fatigue life.

Next, Requirement [III] will be described below.

Requirement [III] is to be such that the kinematic viscosity at 100° C. (Vc) of the composition is from 4.5 to 8 $mm^2/s$, and the ratio of the kinematic viscosity at 100° C. (Vb) of Component (A) to (Vc) (=Vb/Vc) is 0.70 or greater.

When the kinematic viscosity of the composition is constant, the Vb/Vc is preferably 0.75 or greater, more preferably 0.80 or greater, and particularly preferably 0.90 or greater and 1.0 or less with the objective of improving fatigue life.

In Requirement [III], Component (A) is composed of the above-described Component (A1) or Components (A1) and (A2). There is no particular restriction on the contents of Components (A1) and (A2) when used in combination. The content of Component (A1) is preferably from 70 to 97 percent by mass and more preferably from 85 to 95 percent by mass while the content of Component (A2) is preferably from 3 to 30 percent by mass and more preferably from 5 to 15 percent by mass, on the basis of the total amount of the lubricating oil composition.

As described above, Component (A) of Requirement [III] is a lubricating base oil composed of Component (A1) or Components (A1) and (A2). The kinematic viscosity at 100° C. of Component (A) is preferably from 4.5 to 6 $mm^2/s$, more preferably from 5.0 to 5.7 $mm^2/s$, and particularly preferably from 5.2 to 5.5 $mm^2/s$. The kinematic viscosity at 100° C. of 6 $mm^2/s$ or lower renders it possible to produce a lubricating oil composition which is small in friction resistance at lubricating sites due to its small fluid resistance and is excellent in low temperature viscosity (for example, a Brookfield viscosity at −40° C. of 150000 mPa·s or lower) particularly as a transmission oil or a gear oil. The kinematic viscosity at 100° C. of 4.5 $mm^2$/or higher renders it possible to produce a lubricating oil composition which is sufficient in oil film formation, excellent in fatigue life, and less in evaporation loss of the base oil at elevated temperatures.

Component (B) of Requirement [III] is (B3) a poly(meth) acrylate-based additive having a weight-average molecular weight of 50000 to 300000 and substantially composed of only a structural unit of formula (1) wherein $R_1$ is hydrogen or methyl, $R_2$ is a hydrocarbon group having 5 to 20 carbon atoms or a group represented by $—(R)_a$-E wherein R is an alkylene group having 5 to 20 carbon atoms, E is an amine residue or a heterocyclic residue, each having 1 or 2 nitrogen atoms and 0 to 2 oxygen atoms, and a is an integer of 0 or 1.

Examples of the poly(meth)acrylate substantially composed of only a structural unit of formula (1) wherein $R_1$ is hydrogen or methyl, $R_2$ is a hydrocarbon group having 5 to 20 carbon atoms or a group represented by $—(R)_a$-E wherein R is an alkylene group having 5 to 20 carbon atoms, E is an amine residue or a heterocyclic residue, each having 1 or 2 nitrogen atoms and 0 to 2 oxygen atoms, and a is an integer of 0 or 1, constituting Component (B3) include poly(meth)acrylates obtained by polymerizing or copolymerizing one or more types of monomers represented by formula (3'):

$$CH_2{=}C(R_1){-}C({=}O){-}OR_2 \quad (3')$$

wherein $R_1$ and $R_2$ are as described above.

Specific examples of the monomer include the above-described Components (Bb) and (Be) and the following monomers (Bg):

Component (Bg): (meth)acrylates having an alkyl group having 16 to 20 carbon atoms.

Examples of Component (Bg) include (meth)acrylates having preferably a straight-chain alkyl group having 16 to 20 carbon atoms, more preferably a straight-chain alkyl group having 16 or 18 carbon atoms. Specific examples include n-hexadecyl(meth)acrylate, n-octadecyl(meth)acrylate, and n-eicosyl(meth)acrylate.

In the present invention, Component (B3) is preferably a poly(meth)acrylate which is a copolymer of a monomer of one or more types of monomers selected from (Bb) monomers and one or more types of monomers selected from (Bg) monomers (if necessary, one or more types of monomers selected from (Be) monomers may also be copolymerized) and more preferably which is a copolymer of (Bb) a (meth) acrylate mixture having a straight-chain alkyl group having 12 to 15 carbon atoms and a monomer mixture composed of (Bg) a meth (acrylate) having a straight-chain alkyl group having 16 carbon atoms and a meth(acrylate) having a straight-chain alkyl group having 18 carbon atoms, as the main components.

There is no particular restriction on the weight-average molecular weight of Component (B3). However, the weight-average molecular weight is preferably from 50000 to 300000, more preferably from 60000 to 250000, more preferably from 80000 to 230000, and particularly preferably from 200000 to 230000 in view of excellent low temperature viscosity and fatigue life.

There is no particular restriction on the ratio of the weight-average molecular weight (Mw) to the number-average molecular weight of Component (B3). However, the ratio is preferably from 1.5 to 4, more preferably from 2 to 3.5, and particularly preferably from 2.2 to 3.

The weight-average molecular weight and the number-average molecular weight used herein denote a weight-average molecular weight and a number-average molecular weight in terms of polystyrene determined with a differential refractive index detector (RI) at a temperature of 23° C., a flow rate of 1 mL/min, a sample concentration of 1 percent by mass, using 150-C ALC/GPC manufactured by Waters having two columns GMHHR-M (7.8 mm Id×30 cm) equipped in series therein and tetrahydrofuran as a solvent.

The content of (B3) a poly(meth)acrylate-based additive used in Requirement [III] is to be such an amount that the kinematic viscosity at 100° C. (Vc) of the composition is from 4.5 to 8 $mm^2/s$, the viscosity index of the composition is from 95 to 200, and the Vb/Vc is 0.70 or greater. More specifically, the content is usually from 0.1 to 2 percent by mass and preferably from 0.2 to 1 percent by mass.

The transmission lubricating oil composition fulfilling Requirement [III] is excellent in low temperature viscosity and fatigue life but may further contain a non-dispersion type or dispersion type poly(meth)acrylate-based additive other than the above-described Component (B3), as Component (B) as long as the kinematic viscosity at 100° C. (Vc) of the composition is from 4.5 to 8 $mm^2/s$, the viscosity index of the composition is from 95 to 200, and the Vb/Vc is 0.70 or greater.

Preferably, the lubricating oil composition contains (B4) a poly(meth)acrylate containing a structural unit represented by formula (1) wherein $R_1$ is hydrogen or methyl, and $R_2$ is methyl.

The poly(meth)acrylate constituting Component (B4) may be a poly(meth)acrylate obtained by polymerizing a monomer (B4') represented by formula (4') or a copolymer of a monomer represented by formula (4') and a monomer other than the monomer represented by formula (4'):

$$CH_2{=}C(R_1){-}C({=}O){-}OR_2 \quad (4)$$

wherein $R_1$ is hydrogen or methyl, and $R_2$ is methyl.

Specific example of the monomer represented by formula (4') includes methyl(meth)acrylate.

Examples of the monomer other than the monomer represented by formula (4') include the following Components (Ba') and the above-described Components (Bb) to (Be):

Component (Ba'): (meth)acrylates having an alkyl group having 2 to 4 carbon atoms.

Specific examples of Component (Ba') include ethyl(meth) acrylate, n- or i-propyl(meth)acrylate, and n-, i- or sec-butyl (meth)acrylate.

Component (B4) is a poly(meth)acrylate-based compound obtained by polymerizing monomer (B4') or obtained by copolymerizing the above-described Components (B4') and (Ba') and one or more types of monomers selected from the above-described Components (Bb) to (Be). More preferable specific examples include the following compounds:

(1) non-dispersion type poly(meth)acrylates, which are copolymers of (B4') and (Bb), or hydrogenated compounds thereof;

(2) non-dispersion type poly(meth)acrylates, which are copolymers of (B4'), (Bb) and (Bc), or hydrogenated compounds thereof;

(3) non-dispersion type poly(meth)acrylates, which are copolymers of (B4'), (Bb), (Bc) and (Bd), or hydrogenated compounds thereof;

(4) dispersion type poly(meth)acrylates, which are copolymers of (B4'), (Bb) and (Be), or hydrogenated compounds thereof;

(5) dispersion type poly(meth)acrylates, which are copolymers of (B4'), (Bb), (Bc) and (Be), or hydrogenated compounds thereof; and (6) dispersion type poly(meth)acrylates, which are copolymers of (B4'), (Bb), (Bc), (Bd) and (Be), or hydrogenated compounds thereof. Preferred are non-dispersion type poly(meth)acrylates (1) to (3), more preferred are non-dispersion type poly(meth)acrylates (2) and (3) and particularly preferred are non-dispersion type poly(meth)acrylates (3).

The composition ratio of the structural unit of formula (1) wherein $R_1$ is hydrogen or methyl and $R_2$ is methyl is preferably 5 percent by mole or more, more preferably 15 percent by mole or more, and particularly preferably 30 percent by mole or more and preferably 80 percent by mole or less, more preferably 60 percent by mole or less, and in view of low temperature viscosity characteristics particularly preferably 50 percent by mole or less, on the basis of the total amount of the monomer constituting the poly(meth)acrylate.

There is no particular restriction on the weight-average molecular weight of Component (B4), which is usually from 5000 to 150000. However, the weight-average molecular weight is preferably from 10000 to 60000, more preferably from 15000 to 60000, more preferably from 15000 to 30000, and particularly preferably from 15000 to 24000 with the objective of improving fatigue life.

When the transmission lubricating oil composition fulfilling Requirement [III] contains (B4) a poly(meth)acrylate-based additive, the content thereof is to be such an amount that the kinematic viscosity at 100° C. (Vc) of the composition is from 4.5 to 8 $mm^2/s$, the viscosity index of the composition is from 95 to 200, and the Vb/Vc is 0.70 or greater. More specifically, the content is usually from 0.1 to 5 percent by mass, preferably from 0.5 to 2 percent by mass, and particularly preferably from 0.8 to 1.5 percent by mass, on the basis of the total amount of the composition. Component (B4) blended in the above-described range renders it possible to produce a composition excellent in fatigue life and low temperature viscosity characteristics. When the content of Component (B4) exceeds the above-described range, it is not preferable because the resulting composition not only fails to be improved in an effect of improving fatigue life as balanced with the content but also is poor in shear stability and hard to retain the initial extreme pressure properties for a long period of time.

The transmission lubricating oil composition fulfilling Requirement [I] may contain, in addition to Component (B1), a polymer other than Component (B1), for example a non-dispersion type or dispersion type poly(meth)acrylate-based additive (more specifically Components (B2), (B3) and (B4)) other than Component (B1) and one or more types of polymers selected from those other than the poly(meth)acrylate-based additive as long as the composition fulfills Requirement [I]. When the composition contains these components, the content thereof is usually from 0.01 to 10 percent by mass. In particular, the composition contains Component (B3) in an amount of preferably 0.1 to 2 percent by mass and more preferably 0.2 to 1 percent by mass.

The transmission lubricating oil composition fulfilling Requirement [II] may contain, in addition to Component (B2), a polymer other than Component (B2), for example a non-dispersion type or dispersion type poly(meth)acrylate-based additive other than Component (B2) (more specifically Components (B1), (B3) and (B4)) and one or more types of polymers selected from those other than the poly(meth)acrylate-based additive as long as the composition fulfills Requirement [II]. When the composition contains these components, the content thereof is usually from 0.01 to 10 percent by mass. In particular, the composition contains Component (B3) in an amount of preferably 0.1 to 2 percent by mass and more preferably 0.2 to 1 percent by mass.

The transmission lubricating oil composition fulfilling Requirement [III] may contain, in addition to Component (B3) or Components (B3) and (B4), a non-dispersion type or dispersion type poly(meth)acrylate-based additive such as Component (B1) or (B2) and one or more types of polymers selected from those other than the poly(meth)acrylate-based additive. When the composition contains these components, the content thereof is usually from 0.01 to 10 percent by mass. However, the content is preferably to be such that Requirement [III] is fulfilled.

Examples of the polymer other than the poly(meth)acrylate-based additive include non-dispersion type or dispersion type ethylene-α-olefin copolymers and hydrogenated compounds thereof, polyisobutylene and hydrogenated compounds thereof, styrene-diene hydrogenated copolymers, styrene-maleic anhydride ester copolymers, and polyalkylstyrenes.

Preferably, the transmission lubricating oil composition of the present invention contains (C) an imide-based friction modifier having a hydrocarbon group having 8 to 30 carbon atoms and (D) a sulfur-free phosphorus-based extreme pressure additive for the purpose of further enhancing the performances of the composition.

There is no particular restriction on Component (C) which may be used in the present invention as long as Component (C) has a hydrocarbon group having 8 to 30 carbon atoms and an imide structure. For Example, Component (C) is preferably a succinimide represented by formula (2) or (3) and/or a derivative thereof:

(2)

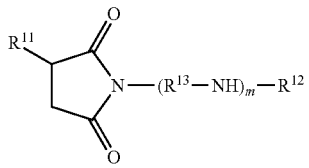

(3)

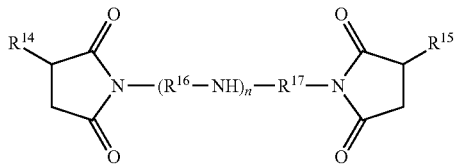

In formula (2), $R^{11}$ is a straight-chain or branched hydrocarbon group having 8 to 30 carbon atoms, $R^{12}$ is hydrogen or a hydrocarbon group having 1 to 30 carbon atoms, $R^{13}$ is a hydrocarbon group having 1 to 4 carbon atoms, and m is an integer of 1 to 7.

In formula (3), $R^{14}$ and $R^{15}$ are each independently a straight-chain or branched hydrocarbon group having 8 to 30 carbon atoms, $R^{16}$ and $R^{17}$ are each independently a hydrocarbon group having 1 to 4 carbon atoms, and n is an integer of 1 to 7.

$R^{11}$ in formula (2) and $R^{14}$ and $R^{15}$ in formula (3) are each independently a straight-chain or branched hydrocarbon group having 8 to 30 carbon atoms, preferably 12 to 25 carbon atoms. Examples of such a hydrocarbon group include alkyl and alkenyl groups. Preferred are alkyl groups. Examples of alkyl groups include octyl, octenyl, nonyl, noneyl, decyl, decenyl, dodecyl, dodecenyl, octadecyl, octadecenyl groups as well as straight-chain or branched alkyl groups having up to 30 carbon atoms. When the hydrocarbon group has fewer than 8 or more than 30 carbon atoms, it is difficult to obtain sufficient anti-shudderproperties. In the present invention, the hydrocarbon group is more preferably a branched alkyl group having 8 to 30 carbon atoms and particularly preferably a branched alkyl group having 10 to 25 carbon atoms. The use of a branched alkyl group having 8 to 30 carbon atoms renders it possible to produce a lubricating oil composition which is more enhanced in anti-shudder durability, compared with the use of a straight-chain alkyl group.

$R^{13}$ in formula (2) and $R^{16}$ and $R^{17}$ in formula (3) are each independently a hydrocarbon group having 1 to 4 carbon atoms. Examples of such a hydrocarbon group include alkylene groups having 1 to 4 carbon atoms. The hydrocarbon group is preferably an alkylene group having 2 or 3 carbon atoms (ethylene and propylene groups).

$R^{12}$ in formula (2) is hydrogen or a straight-chain or branched hydrocarbon group having 1 to 30 carbon atoms. Examples of the straight-chain or branched hydrocarbon group having 1 to 30 carbon atoms include straight-chain or branched alkyl and alkenyl groups having 1 to 30 carbon atoms. The hydrocarbon group is a branched alkyl or alkenyl group having preferably 1 to 30 carbon atoms, more preferably 8 to 30 carbon atoms, and more preferably 10 to 25 carbon atoms. Particularly preferred are branched alkyl groups.

In formulas (2) and (3), n and m are each an integer of 1 to 7. In order to obtain a lubricating oil composition with more enhanced anti-shudder durability, n and m are each preferably an integer of 1, 2 or 3 and particularly preferably 1.

The succinimide compound represented by formula (2) or (3) may be produced by a conventional method. For example, the compound may be obtained by reacting an alkyl or alkenyl succinic anhydride with a polyamine. Specifically, a mono succinimide of formula (2) wherein $R^{12}$ is hydrogen may be obtained by adding slowly dropwise one mole of succinic anhydride having an straight-chain or branched alkyl or alkenyl group having 8 to 30 carbon atoms to one or more moles of a polyamine such as diethylenetriamine, triethylenetetramine, and tetraethylenepentamine, at a temperature of 130 to 180° C., preferably 140 to 175° C. under nitrogen atmosphere and reacting the compounds for one to 10 hours, preferably 2 to 6 hours, followed by removal of the unreacted polyamine by distillation. A mono succinimide of formula (2) wherein $R^{12}$ is a hydrocarbon group having 1 to 30 carbon atoms may be obtained by reacting N-octadecyl-1,3-propane diamine and the above succinic anhydride by the same method as described above. A bis succinimide of formula (3) may be obtained by adding dropwise 0.5 mole of a polyamine as mentioned above to one mole of a succinic anhydride under the same conditions as described above and reacting these compounds in the same manner as described above, followed by removal of the produced water.

Examples of derivatives of the succinimides of formulas (2) and (3) include compounds obtained by modifying the succinimides with boric acid, phosphoric acid, carboxylic acids, derivatives thereof, sulfur compounds, and triazoles. Specific examples of the derivatives and method for producing the same includes those specifically described in Japanese Patent Laid-Open Publication No. 2002-105478.

In the present invention, Component (C) is particularly preferably a bis type succinimide of formula (3) because a composition with more enhanced anti-shudder durability can be obtained, compared with the use of a mono-type succinimide of formula (2).

The content of Component (C) in the transmission lubricating oil composition of the present invention is preferably one percent by mass or more and more preferably 2 percent by mass or more on the basis of the total amount of the composition. On the other hand, the content is preferably 5 percent by mass or less and more preferably 4 percent by mass or less on the basis of the total amount of the composition. When the content of Component (C) is less than one percent by mass, it would be difficult to achieve the higher target of the present invention regarding anti-shudder durability (anti-shudder durability; for example 300 hours or longer). When the content of Component (C) is in excess of 5 percent by mass, the fatigue life would tend to degrade.

Specific examples of (D) a sulfur-free phosphorus-based extreme pressure additive include phosphoric acid monoesters, phosphoric acid diesters, phosphoric acid triesters, phosphorus acid monoesters, phosphorus acid diesters, and phosphorus acid triesters, each having an alkyl or aryl group having 3 to 30 carbon atoms, preferably 4 to 18 carbon atoms, and salts of these esters and amines, alkanol amines, or metals such as zinc.

In the present invention, Component (D) is preferably phosphoric and phosphorus acid esters having an alkyl group having 3 to 30 carbon atoms and particularly preferably phosphorus acid esters having 3 to 30 carbon atoms.

The content of Component (D) is preferably from 0.015 to 0.05 percent by mass and more preferably from 0.02 to 0.04 percent by mass in terms of phosphorus on the basis of the total amount of the composition. When the phosphorus content of Component (D) is less than the above range, the resulting composition would tend to be degraded in anti-shudder durability while the phosphorus content exceeds the above range, the resulting composition would tend to be degraded in fatigue life.

If necessary, the transmission lubricating oil composition of the present invention may further contain any of one or more additives selected from those such as viscosity index improvers, extreme pressure additives other than Component (D), dispersants, metallic detergents, friction modifiers other than Component (C), anti-oxidants, corrosion inhibitors, rust inhibitors, demulsifiers, metal deactivators pour point depressants, seal swelling agents, anti-foaming agents and dyes for the purposes of enhancing the performances of or providing performances necessary for a transmission lubricating oil.

Examples of the viscosity index improvers include known non-dispersion and dispersion types polymethacrylates (excluding Components (B)), non-dispersion and dispersion types ethylene-α-olefin copolymers and hydrogenated compounds thereof, polyisobutylene and hydrogenated compounds thereof, styrene-diene hydrogenated copolymers, styrene-maleic anhydride ester copolymers, and polyalkylstyrenes.

When the transmission lubricating oil composition of the present invention contains a viscosity index improver (excluding Component (B)), there is no particular restriction on the content thereof as long as the kinematic viscosity at 100° C. and viscosity index of the composition fall within the range defined by the present invention. The content is usually from 0.1 to 15 percent by mass and preferably from 0.5 to 5 percent by mass on the basis of the total amount of the composition.

Examples of the extreme pressure additives other than Component (D) include those composed of at least one type of sulfur-based extreme pressure additive selected from sulfurized fats and oils, olefin sulfides, dihydrocarbyl polysulfides, dithiocarbamates, thiadiazoles and benzothiazoles and/or at least one type of phosphorus-sulfur-based extreme pressure additive selected from thiophosphorus acid, thiophosphorus acid monoesters, thiophosphorus acid diesters, thiophosphorus acid triesters, dithiophosphorus acid, dithiophosphorus acid monoesters, dithiophosphorus acid diesters, dithiophosphorus acid triesters, trithiophosphorus acid, trithiophosphorus acid moncesters, trithiophosphorus acid diesters, trithiophosphorus acid triesters and salts thereof.

Examples of the dispersants include ashless dispersants such as succinimides, benzylamines and polyamines, each having a hydrocarbon group having 40 to 400 carbon atoms, and/or boron compound derivatives thereof.

In the present invention, any one or more types of compounds selected from the above-exemplified dispersants may be blended in any amount. However, the content is usually from 0.01 to 15 percent by mass and preferably from 0.1 to 8 percent by mass on the basis of the total amount of the composition.

Examples of the metallic detergents include alkaline earth metal sulfonates, alkaline earth metal phenates, and alkaline earth metal salicylates.

In the present invention, any one or more types of compounds selected from the above-exemplified metallic detergents may be blended in any amount. However, the content is usually from 0.01 to 10 percent by mass and preferably from 0.1 to 5 percent by mass on the basis of the total amount of the composition.

Examples of the friction modifiers other than Component (C) include any compounds which are usually used as friction modifiers for lubricating oils. Component (C) is preferably an amine compound, a fatty acid ester, a fatty acid amide, or a fatty acid metal salt, each having in its molecule at least one alkyl or alkenyl group having 6 to 30 carbon atoms in particular at least one straight-chain alkyl or alkenyl group having 6 to 30 carbon atoms.

In the present invention, any one or more types of compounds selected from the above-exemplified friction modifiers may be blended in any amount. However, the content is usually from 0.01 to 5.0 percent by mass and preferably from 0.03 to 3.0 percent by mass on the basis of the total amount of the composition.

The anti-oxidants may be any of those generally used in a lubricating oil, such as phenol- or amine-based compounds.

Specific examples of the anti-oxidants include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; zinc dialkyldithiophosphates such as zinc di-2-ethylhexyldithiophosphate; and esters of (3,5-di-tert-butyl-4-hydroxyphenyl)fatty acid (propionic acid) or (3-methyl-5-tert-butyl-4-hydroxyphenyl) fatty acid (propionic acid) with a monohydric or polyhydric alcohol such as methanol, octanol, octadecanol, 1,6-hexanediol, neopentyl glycol, thiodiethylene glycol, triethylene glycol and pentaerythritol.

One or more compounds selected from these antioxidants may be blended in an arbitrary amount, but is usually blended in an amount of from 0.01 to 5.0 percent by mass, preferably from 0.1 to 3 percent by mass on the basis of the total amount of the composition.

Examples of the corrosion inhibitors include benzotriazole-, tolyltriazole, thiadiazole-, and imidazole-based compounds.

Examples of the rust inhibitors include petroleum sulfonates, alkylbenzene sulfonates, dinonylnaphthalene sulfonates, alkenyl succinic acid esters and polyhydric alcohol esters.

Examples of the demulsifiers include polyalkylene glycol-based non-ionic surfactants such as polyoxyethylenealkyl ethers, polyoxyethylenealkylphenyl ethers and polyoxyethylenealkylnaphthyl ethers.

Examples of the metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole and β-(o-carboxybenzylthio)propionitrile.

The pour point depressants may be any of known pour point depressants selected depending on the type of lubricating base oil but are preferably polymethacrylates having a weight average molecular weight of preferably 20000 to 500000, more preferably 50000 to 300000, and particularly preferably 80000 to 200000.

The anti-foaming agents may be any of compounds generally used as anti-foaming agents for lubricating oils, including silicones such as dimethylsilicone and fluorosilicone. One or more types of compounds arbitrarily selected from such silicones may be blended in an arbitrary amount.

The seal swelling agents may be any of compounds generally used as seal swelling agents for lubricating oils, such as ester-, sulfur- and aromatic-based swelling agents.

The dyes may be any of compounds generally used as dyes for lubricating oil and may be blended in an arbitrary amount but in an amount of usually from 0.001 to 1.0 percent by mass based on the total amount of the composition.

When these additives are contained in the transmission lubricating oil composition of the present invention, the corrosion inhibitor, rust inhibitor and demulsifier are each contained in an amount of from 0.005 to 5 percent by mass, the metal deactivator and the pour point depressant are each contained in an amount of from 0.005 to 2 percent by mass, the seal swelling agent is contained in an amount of 0.01 to 5 percent by mass, and the anti-foaming agent is contained in an amount of from 0.0005 to 1 percent by mass, on the basis of the total amount of the composition.

The transmission lubricating oil composition of the present invention is provided with excellent fatigue life because it is constituted as described above. However, in order to further enhance the fuel efficiency caused by a reduction in stirring resistance, compared with the conventional lubricating oil composition for automatic transmissions, continuously variable transmissions, and manual transmissions, the kinematic viscosity at 100° C. of the composition is adjusted to 8 $mm^2/s$ or less, preferably 7 $mm^2/s$ or less, more preferably 6.5 $mm^2/s$ or less, and particularly preferably 6 $mm^2/s$ or less. The kinematic viscosity at 40° C. of the composition is adjusted to preferably 40 $mm^2/s$ or less, more preferably 35 $mm^2/s$ or less, and particularly preferably 30 $mm^2/s$ or less. Furthermore, in order to further enhance the extreme pressure properties required for a lubricating oil composition for automatic, continuously variable, and manual transmissions, the kinematic viscosity at 100° C. of the composition is adjusted to preferably 3 $mm^2/s$ or higher, more preferably 4 $mm^2/s$ or higher, and particularly preferably 5 $mm^2/s$ or higher while the kinematic viscosity at 40° C. of the composition is preferably 15 $mm^2/s$ or higher, more preferably 20 $mm^2/s$ or higher, and particularly preferably 25 $mm^2/s$ or higher.

The transmission lubricating oil composition of the present invention is excellent in fatigue life and reduced in stirring resistance caused by a lubricating base oil by optimizing the base oil even though containing a poly(meth)acrylate which is poor in fatigue life. Therefore, when the composition is used for an automobile transmission, particularly an automatic transmission, a continuously variable transmission, or a manual transmissions, or an automobile final reduction gear unit, it is able to contribute to an improvement in the fuel efficiency of the automobile.

APPLICABILITY IN THE INDUSTRY

The transmission lubricating oil composition of the present invention is excellent in anti-shudder durability, low temperature viscosity characteristics and oxidation stability even though having a low viscosity and also can provide the gears and bearings of the automatic, manual and continuously variable transmission of automobiles with sufficient durability and thus can achieve an improvement in the fuel efficiency of the automobiles.

BEST MODE FOR CARRYING OUT THE INVENTION

Hereinafter, the present invention will be described in more details by way of the following examples and comparative examples, which should not be construed as limiting the scope of the invention.

EXAMPLES 1 TO 20, COMPARATIVE EXAMPLES 1 TO 9, AND REFERENCE EXAMPLES 1 TO 3)

Transmission lubricating oil compositions according to the present invention (Examples 1 to 20) were prepared in accordance with the formulations set forth in Tables 1 to 4. These lubricating oil compositions were subjected to performance evaluating tests described below, and the results are also set forth in Tables 1 to 4.

Transmission lubricating oil compositions for comparison (Comparative Examples 1 to 9) were also prepared in accordance with the formulations set forth in Tables 1 to 4. These lubricating oil compositions were also subjected to performance evaluating tests described below, and the results are also set forth in Tables 1 to 4.

(a) Fatigue Life Test

The fatigue life of each of the compositions was determined in accordance with IP300/82 "Rolling Contact Fatigue Test For Fluid in a Modified Four-Ball Machine" wherein a test condition "7. Procedure B" was changed as follow, using a four-ball extreme-pressure lubricant testing machine.

(Test Conditions)

Number of revolutions: 3000 rpm

Oil temperature: 120° C.

Surface pressure: 3.9 GPa (Evaluation Criterion)

Time consumed until pitching generated on the balls was evaluated as fatigue life, and L50 (average) was calculated from 3 times test results.

(b) Low Temperature Viscosity Measurement

The low temperature viscosity at −40° C. of each of the transmission lubricating oil compositions was measured in a liquid bath cryostat in accordance with "Testing Methods for Low-Temperature Viscosity of Gear Oils". In the present invention, the low temperature viscosity is preferably 20,000 mPa·s or lower and in view of excellent fatigue life 10,000 mPa·s or greater.

(c) High-Speed Four Ball Test

A high-speed four ball test was carried out at an oil temperature of 100° C., a load of 294 N and a revolution number of 1500 rpm in accordance with ASTM D4172-94 to measure the wear scar diameter (mm) after the lapse of one hour.

(d) Anti-Shudder Durability

A low velocity sliding test was carried out in accordance with "Automatic transmission fluids-anti-shudder performance test" specified by JASO M349-98 wherein only the oil temperature during the test was changed from 120° C. to 140° C. thereby evaluating the anti-shudder durability of each of the Example and Comparative Example compositions. The durability of the reference oil specified by this test method is 72 hours. However, the present invention aims at obtaining the durability 4 times that of the reference oil (800 h). When the durability exceeded 600 hours, the test was discontinued.

(e) Oxidation Stability

Each of the compositions was forced to degrade at 165.5° C. in an ISOT test in accordance with JIS K 2514, and the increase of acid number (mgKOH/g) after the lapse of 72 hours was measured.

TABLE 1

| | | Example 1 | Example 2 | Example 3 | Example 4 | Example 5 | Example 6 |
|---|---|---|---|---|---|---|---|
| (A) Base oil (on the basis of the total amount thereof) | | | | | | | |
| (A1a) Base oil A [1)] | Mass % | 17 | 58 | 36 | 42 | 50 | 17 |
| (A1b) Base oil B [2)] | Mass % | 83 | 20 | 54 | 43 | 40 | 83 |
| (A1c) Base oil C [3)] | Mass % | | | | 5 | | |
| (A1a) Base oil D [4)] | Mass % | | 22 | | | | |
| (A1a) Base oil E [5)] | Mass % | | | 10 | | | |
| (A1b) Base oil F [6)] | Mass % | | | | 10 | | |
| (A1c) Base oil G [7)] | Mass % | | | | | 10 | |
| Kinematic viscosity (100° C.) of mixed base oil | $mm^2/s$ | 3.8 | 3.8 | 3.8 | 3.8 | 3.8 | 3.8 |
| Additives (on the basis of the total amount of composition) | | | | | | | |
| (B) PMA-A [8)] | Mass % | 5 | 5 | 5 | 5 | 5 | |
| (B) PMA-B [9)] | Mass % | | | | | | 1.9 |
| PMA-C [10)] | Mass % | | | | | | |
| PMA-D [11)] | Mass % | | | | | | |

TABLE 1-continued

| | | | | | | | |
|---|---|---|---|---|---|---|---|
| PMA-E [12] | Mass % | | | | | | |
| Additive package [13] | Mass % | 11 | 11 | 11 | 11 | 11 | 11 |
| Composition properties/test results viscosity (100° C.) | $mm^2/s$ | 5.7 | 5.7 | 5.7 | 5.7 | 5.7 | 5.7 |
| Viscosity index | | 161 | 158 | 161 | 160 | 158 | 163 |
| Low temperature viscosity (BF method; −40° C.) | mPa · s | 16800 | 18700 | 15900 | 16500 | 16900 | 16500 |
| Fatigue life (IP300, L50) | h | 80 | 80 | 80 | 150 | 120 | 70 |

| | | Example 7 | Comparative Example 1 | Comparative Example 2 | Comparative Example 3 |
|---|---|---|---|---|---|
| (A) Base oil (on the basis of the total amount thereof) | | | | | |
| (A1a) Base oil A [1] | Mass % | 42 | 17 | 17 | 17 |
| (A1b) Base oil B [2] | Mass % | 43 | 83 | 83 | 83 |
| (A1c) Base oil C [3] | Mass % | 5 | | | |
| (A1a) Base oil D [4] | Mass % | | | | |
| (A1a) Base oil E [5] | Mass % | | | | |
| (A1b) Base oil F [6] | Mass % | 10 | | | |
| (A1c) Base oil G [7] | Mass % | | | | |
| Kinematic viscosity (100° C.) of mixed base oil | $mm^2/s$ | 3.8 | 3.8 | 3.8 | 3.8 |
| Additives (on the basis of the total amount of composition) | | | | | |
| (B) PMA-A [8] | Mass % | | | | |
| (B) PMA-B [9] | Mass % | 1.9 | | | |
| PMA-C [10] | Mass % | | 5 | | |
| PMA-D [11] | Mass % | | | 10.5 | |
| PMA-E [12] | Mass % | | | | 0.9 |
| Additive package [13] | Mass % | 11 | 11 | 11 | 11 |
| Composition properties/test results viscosity (100° C.) | $mm^2/s$ | 5.7 | 5.7 | 5.7 | 5.7 |
| Viscosity index | | 163 | 158 | 152 | 164 |
| Low temperature viscosity (BF method; −40° C.) | mPa · s | 16100 | 16000 | 18400 | 16800 |
| Fatigue life (IP300, L50) | h | 110 | 50 | 40 | 40 |

Footnote of Table 1

[1]Hydrocracked mineral oil (100° C. kinematic viscosity: 2.6 $mm^2/s$, % $C_A$: 0, sulfur content: <0.001 mass %, viscosity index: 105)

[2]Hydrocracked mineral oil (100° C. kinematic viscosity: 4.2 $mm^2/s$, % $C_A$: 0, sulfur content: <0.001 mass %, viscosity index: 125)

[3]Poly-α olefin base oil (100° C. kinematic viscosity: 4.0 $mm^2/s$, % $C_A$: 0, sulfur content: 0 mass %, viscosity index: 124)

[4]Solvent-refined mineral oil (100° C. kinematic viscosity: 10.84 $mm^2/s$, % $C_A$: 7.4, sulfur content: 0.6 mass %, viscosity index: 94)

[5]Hydrorefined mineral oil (100° C. kinematic viscosity: 11.2 $mmm^2/s$, % $C_A$: 2, sulfur content: 0.04 mass %, viscosity index: 106)

[6]Solvent-refined mineral oil (100° C. kinematic viscosity: 21.9 $mm^2/s$, % $C_A$: 7, ssulfur content: 0.91 mass %, viscosity index: 95)

[7]Solvent-refined mineral oil (100° C. kinematic viscosity: 31.3 $mmm^2/s$, % $C_A$: 7.4, sulfur content: 1.11 mass %, viscosity index: 94)

[8]Non-dispersion type polymethacrylate-based additive (Mw: 22,900) derived from a polymer of a mixture of methyl MA, nC12MA, nC13MA, nC14MA, nC15MA, nC16MA, nC18MA, and 2-decyl-tetradecyl MA, as main components (MA indicates methacrylate, Mw indicates weight-average molecular weight, hereinafter the same)

[9]Non-dispersion type polymethacrylate-based additive (Mw: 50,500) derived from a polymer of a mixture of methyl MA, nC12MA, nC13MA, nC14MA, nC15MA, nC16MA, nC18MA, and 2-decyl-tetradecyl MA, as main components

[10]Non-dispersion type polymethacrylate-based additive (containing no methacrylate having an alkyl group of C16 or more, Mw: 20,500) derived from a polymer of a mixture of methyl MA, nC12MA, nC13MA, nC14MA, and nC15MA, as main components

[11]Non-dispersion type polymethacrylate-based additive (containing no methacrylate having an alkyl group of C16 or more, Mw: 10,000) derived from a polymer of a mixture of methyl MA, nC12MA, nC13MA, nC14MA, and nC15MA, as main components

[12]Non-dispersion type polymethacrylate-based additive (containing no methacrylate having an alkyl group of C16 or more, Mw: 100,000) derived from a polymer of a mixture of methyl MA, nC12MA, nC13MA, nC14MA, and nC15MA, as main components

[13]Containing metallic detergent, dispersant,friction modifier, extreme pressure additive, seal swelling agent, anti-oxidant, and pour point depressant

TABLE 2

| | | Example 8 | Example 9 | Example 10 | Comparative Example 4 | Comparative Example 5 | Comparative Example 6 |
|---|---|---|---|---|---|---|---|
| (A) Base oil (on the basis of the total amount thereof) | | | | | | | |
| (A1a) Base oil A [1] | Mass % | 42 | 50 | 50 | 17 | 17 | 17 |
| (A1b) Base oil B [2] | Mass % | 43 | 40 | 40 | 83 | 83 | 83 |
| (A1c) Base oil C [3] | Mass % | 5 | | | | | |
| (A1b) Base oil D [4] | Mass % | 10 | | | | | |
| (A1c) Base oil E [5] | Mass % | | 10 | 10 | | | |
| Base oil properties | | | | | | | |
| Kinematic viscosity (100° C.) | $mm^2/s$ | 3.8 | 3.8 | 3.8 | 3.8 | 3.8 | 3.8 |

TABLE 2-continued

| | | Example 8 | Example 9 | Example 10 | Comparative Example 4 | Comparative Example 5 | Comparative Example 6 |
|---|---|---|---|---|---|---|---|
| Additives (on the basis of the total amount composition) | | | | | | | |
| (B) PMA-C [6] | Mass % | 5 | | | 5 | | |
| (B) PMA-D [7] | Mass % | | 10.5 | | | 10.5 | |
| (B) PMA-E [8] | Mass % | | | 0.9 | | | 0.9 |
| Additive package [9] | Mass % | 11 | 11 | 11 | 11 | 11 | 11 |
| Composition properties/test results | $mm^2/s$ | 5.7 | 5.7 | 5.7 | 5.7 | 5.7 | 5.7 |
| Kinematic viscosity (100° C.) | | | | | | | |
| Viscosity index | | 158 | 163 | 168 | 158 | 152 | 164 |
| Low temperature viscosity (BF method; −40° C.) | mPa · s | 15800 | 19200 | 18500 | 16000 | 18400 | 16800 |
| Acid number increase (ISOT165.5° C., after 72 hours) | mgKOH/g | 0.48 | 0.68 | 0.64 | 0.54 | 0.6 | 0.65 |
| Fatigue life (IP300, L50) | h | 80 | 60 | 80 | 50 | 40 | 40 |

[1] Hydrocracked mineral oil (100° C. kinematic viscosity: 2.6 $mm^2/s$, % $C_A$: 0, sulfur content: <0.001 mass %, viscosity index: 105),

[2] Hydrocracked mineral oil (100° C. kinematic viscosity: 4.2 $mm^2/s$, % $C_A$: 0, sulfur content: <0.001 mass %, viscosity index: 125),

[3] Poly-α olefin base oil (100° C. kinematic viscosity: 4.0 $mm^2/s$, % $C_A$: 0, sulfur content: 0 mass %, viscosity index: 124),

[4] Solvent-refined mineral oil (100° C. kinematic viscosity: 21.9 $mm^2/s$, % $C_A$: 7, sulfur content: 0.91 mass %, viscosity index: 95),

[5] Solvent-refined mineral oil (100° C. kinematic viscosity: 31.3 $mm^2/s$, % $C_A$: 7.4, sulfur content: 1.11 mass %, viscosity index: 94)

[6] Non-dispersion type polymethacrylate-based additive (containing no methacrylate having an alkyl group of C20 or more, Mw: 20,500) derived from a polymer of a mixture of methyl MA, nC12MA, nC13MA, nC14MA, and nC15MA as a main components (MA: methacrylate),

[7] Non-dispersion type polymethacrylate-based additive (containing no methacrylate having an alkyl group of C20 or more, Mw: 10,000) derived from a polymer of a mixture of methyl MA, nC12MA, nC13MA, nC14MA, and nC15MA as a main components (MA: methacrylate),

[8] Non-dispersion type polymethacrylate-based additive (containing no methacrylate having an alkyl group of C20 or more, Mw: 100,000) derived from a polymer of a mixture of methyl MA, nC12MA, nC13MA, nC14MA, and nC15MA as a main components,

[9] Containing metallic detergent, dispersant, friction modifier, extreme pressure additive, seal swelling agent, antioxidant, and pour point depressant

TABLE 3

| | | Example 11 | Example 12 | Example 13 | Comparative Example 7 | Comparative Example 8 | Comparative Example 9 |
|---|---|---|---|---|---|---|---|
| Base oil (on the basis of the total amount thereof) | | | | | | | |
| (A1a) Base oil A [1] | Mass % | | | | | 17 | 17 |
| (A1b) Base oil B [2] | Mass % | 33 | 53 | 60 | 33 | 83 | 83 |
| (A1b) Base oil C [3] | Mass % | 67 | 47 | 35 | 67 | | |
| (A2b) Base oil D [4] | Mass % | | | 5 | | | |
| Base oil properties kinematic viscosity (100° C.): | | | | | | | |
| Vb | $mm^2/s$ | 5.4 | 5 | 5 | 5.4 | 3.8 | 3.8 |
| Additives (on the basis of the total amount composition) | | | | | | | |
| PMA-A [5] | | 0.3 | 0.3 | 0.3 | — | 0.3 | 0.3 |
| PMA-B [6] | Mass % | | 1 | 1 | | | |
| PMA-C [7] | Mass % | | | | | 0.9 | |
| PMA-D [8] | Mass % | | | | | | 5 |
| Additive package [9] | Mass % | 11 | 11 | 11 | 11 | 11 | 11 |
| Composition properties/test results | $mm^2/s$ | 5.7 | 5.7 | 5.7 | 5.7 | 5.7 | 5.7 |
| Kinematic viscosity (100° C.): Vc | | | | | | | |
| Vb/Vc | | 0.95 | 0.88 | 0.88 | 0.95 | 0.67 | 0.67 |
| Viscosity index | | 123 | 135 | 132 | 123 | 164 | 158 |
| Wear properties (four-ball test) | mm | 0.39 | 0.39 | 0.39 | 0.40 | 0.40 | 0.40 |
| Low temperature viscosity (BF method; −40° C.) | mPa · s | 39000 | 30000 | 53000 | n/a | 16800 | 16000 |
| Fatigue life (IP300, L50) | h | 80 | 100 | 110 | 60 | 40 | 50 |

[1] Hydrocracked mineral oil (100° C. kinematic viscosity: 2.6 $mm^2/s$, % $C_A$: 0, sulfur content: <0.001 mass %, viscosity index: 105)

[2] Hydrocracked mineral oil (100° C. kinematic viscosity: 4.2 $mm^2/s$, % $C_A$: 0, sulfur content: <0.001 mass %, viscosity index: 125)

[3] Hydrocracked mineral oil (100° C. kinematic viscosity: 6.2 $mm^2/s$, % $C_A$: 0, sulfur content: 0.001 mass %, viscosity index: 132)

[4] Solvent-refined mineral oil (100° C. kinematic viscosity: 21.9 $mm^2/s$, % $C_A$: 7, sulfur content: 0.91 mass %, viscosity index: 95)

[5] Non-dispersion type polymethacrylate-based additive (Mw: 217,000, Mw/Mn = 2.85) derived from a polymer of a mixture of nC12MA, nC13MA, nC14MA, nC15MA, nC16MA and nC18MA as a main components (MA: methacrylate)

[6] Non-dispersion type polymethacrylate-based additive (containing no methacrylate having an alkyl group of C20 or more, Mw: 22,900) derived from a polymer of a mixture of methyl MA, nC12MA, nC13MA, nC14MA, nC15MA, nC16MA, nC18MA and 2-decyl-tetradecyl MA as a main components (MA: methacrylate),

[7] Non-dispersion type polymethacrylate-based additive (Mw: 100,000) derived from a polymer of a mixture of methyl MA, nC12MA, nC13MA, nC14MA, and nC15MA as a main components,

[8] Non-dispersion type polymethacrylate-based additive (Mw: 10,000) derived from a polymer of a mixture of methyl MA, nC12MA, nC13MA, nC14MA, and nC15MA as a main components

[9] Containing metallic detergent, dispersant, friction modifier, extreme pressure additive, seal swelling agent and anti-oxidant

TABLE 4

| | | Example 14 | Example 15 | Example 16 | Example 17 | Example 18 |
|---|---|---|---|---|---|---|
| (A) Base oil (on the basis of the total amount thereof) | | | | | | |
| (A1a) Base oil A [1)] | Mass % | 17 | 78 | 42 | 42 | 42 |
| (A1b) Base oil B [2)] | Mass % | 83 | | 43 | 43 | 43 |
| (A1c) Base oil C [3)] | Mass % | | | 5 | 5 | 5 |
| (A2a) Base oil C [4)] | Mass % | | | | | |
| (A2b) Base oil D [5)] | Mass % | | 22 | 10 | 10 | 10 |
| (A2c) Base oil E [6)] | Mass % | | | | | |
| Base oil properties | | | | | | |
| Kinematic viscosity (100° C.) | $mm^2/s$ | 3.8 | 3.8 | 3.8 | 3.8 | 3.8 |
| Additives (on the basis of the total amount of composition) | | | | | | |
| (B) VM-A [7)] | Mass % | 5 | 5 | 5 | | |
| (B) VM-B [8)] | Mass % | | | | 1.9 | |
| (B) VM-C [9)] | Mass % | | | | | 5 |
| VM-F [10)] | Mass % | 0.3 | 0.3 | 0.3 | 0.3 | 0.3 |
| (C) Imide-based FM [11)] | Mass % | 3 | 3 | 3 | 3 | 3 |
| Polybutenyl succinimide [12)] | Mass % | | | | | |
| (D)Non-sulfur-based phosphorus compound [13)] | (P)Mass % | 0.03 | 0.03 | 0.03 | 0.03 | 0.03 |
| Thiophosphate | (P)Mass % | | | | | |
| Metallic detergent [14)] | (Ca) Mass % | 0.01 | 0.01 | 0.01 | 0.01 | 0.01 |
| Additive package [15)] | Mass % | 8 | 8 | 8 | 8 | 8 |
| Composition properties/test results viscosity (100° C.) | $mm^2/s$ | 5.7 | 5.7 | 5.7 | 5.7 | 5.7 |
| Viscosity index | | 161 | 157 | 160 | 163 | 158 |
| Anti-shudder durability | h | 600 | 600 | 600 | 600 | 600 |
| Low temperature viscosity (BF method; −40° C.) | mPa · s | 16800 | 18900 | 16500 | 16100 | 15800 |
| Acid number increase (ISOT165.5° C., after 72 hours) | mgKOH/g | 0.48 | 0.59 | 0.56 | 0.52 | 0.54 |
| Fatigue life (IP300, L50) | h | 80 | 80 | 150 | 110 | 80 |

| | | Example 19 | Example 20 | Reference Example 1 | Reference Example 2 | Reference Example 3 |
|---|---|---|---|---|---|---|
| (A) Base oil (on the basis of the total amount thereof) | | | | | | |
| (A1a) Base oil A [1)] | Mass % | 50 | | 42 | 42 | 42 |
| (A1b) Base oil B [2)] | Mass % | 40 | 60 | 43 | 43 | 43 |
| (A1c) Base oil C [3)] | Mass % | | | 5 | 5 | 5 |
| (A2a) Base oil C [4)] | Mass % | | 35 | | | |
| (A2b) Base oil D [5)] | Mass % | | 5 | 10 | 10 | 10 |
| (A2c) Base oil E [6)] | Mass % | 10 | | | | |
| Base oil properties | | | | | | |
| Kinematic viscosity (100° C.) | $mm^2/s$ | 3.8 | 5 | 3.8 | 3.8 | 3.8 |
| Additives (on the basis of the total amount of composition) | | | | | | |
| (B) VM-A [7)] | Mass % | 5 | 1 | 5 | 5 | 5 |
| (B) VM-B [8)] | Mass % | | | | | |
| (B) VM-C [9)] | Mass % | | | | | |
| VM-F [10)] | Mass % | 0.3 | 0.3 | 0.3 | 0.3 | 0.3 |
| (C) Imide-based FM [11)] | Mass % | 3 | 3 | | 3 | 0.5 |
| Polybutenyl succinimide [12)] | Mass % | | | 3 | | |
| (D)Non-sulfur-based phosphorus compound [13)] | (P)Mass % | 0.03 | 0.03 | 0.03 | | 0.03 |
| Thiophosphate | (P)Mass % | | | | 0.03 | |
| Metallic detergent [14)] | (Ca) Mass % | 0.01 | 0.01 | 0.01 | 0.01 | 0.01 |
| Additive package [15)] | Mass % | 8 | 8 | 8 | 8 | 8 |
| Composition properties/test results viscosity (100° C.) | $mm^2/s$ | 5.7 | 5.7 | 5.7 | 5.7 | 5.7 |

TABLE 4-continued

| | | | | | | |
|---|---|---|---|---|---|---|
| Viscosity index | | 160 | 132 | 160 | 160 | 160 |
| Anti-shudder durability | h | 600 | 600 | 40 | 80 | 100 |
| Low temperature viscosity (BF method; −40° C.) | mPa · s | 16900 | 53000 | 16500 | 16500 | 16100 |
| Acid number increase (ISOT165.5° C., after 72 hours) | mgKOH/g | 0.97 | 0.54 | 0.57 | 0.98 | 0.56 |
| Fatigue life (IP300, L50) | h | 120 | 120 | 120 | 120 | 120 |

Footenote of Table 4

[1)]Hydrocracked mineral oil (100° C. kinematic viscosity: 2.6 $mm^2/s$, % $C_A$: 0, sulfur content: <0.001 mass %, viscosity index: 105)

[2)]Hydrocracked mineral oil (100° C. kinematic viscosity: 4.2 $mm^2/s$, % $C_A$: 0, sulfur content: <0.001 mass %, viscosity index: 125)

[3)]Poly-α olefin base oil (100° C. kinematic viscosity: 4.0 $mm^2/s$, % $C_A$: 0, sulfur content: 0 mass %, viscosity index: 124)

[4)]Hydrocracked mineral oil (100° C. kinematic viscosity: 6.2 $mm^2/s$, % $C_A$: 0, sulfur content: 0.001 mass %, viscosity index: 132)

[5)]Solvent-refined mineral oil (100° C. kinematic viscosity: 21.9 $mm^2/s$, % $C_A$: 7, sulfur content: 0.91 mass %, viscosity index: 95)

[6)]Solvent-refined mineral oil (100° C. kinematic viscosity: 31.3 $mm^2/s$, % $C_A$: 7.4, sulfur content: 1.11 mass %, viscosity index: 94)

[7)]Non-dispersion type polymethacrylate-based additive (Mw: 22,900) derived from a polymer of a mixture of methyl MA, nC12MA, nC13MA, nC14MA, nC15MA, nC16MA, nC18MA, and 2-decyl-tetradecyl MA, as main components (MA indicates methacrylate, Mw indicates weight-average molecular weight, hereinafter the same)

[8)]Non-dispersion type polymethacrylate-based additive (Mw: 50,500) derived from a polymer of a mixture of methyl MA, nC12MA, nC13MA, nC14MA, nC15MA, nC16MA, nC18MA, and 2-decyl-tetradecyl MA, as main components

[9)]Non-dispersion type polymethacrylate-based additive (Mw: 20,500) derived from a polymer of a mixture of methyl MA, nC12MA, nC13MA, nC14MA, and nC15MA, as main components

[10)]Non-dispersion type polymethacrylate-based additive (Mw: 217,000) derived from a polymer of a mixture of nC12MA, nC13MA, nC14MA, nC15MA, nC16MA, and nC18MA, as main components

[11)]diethylenetriamine bis(isooctyldecyl)succinimide

[12)]polybutenyl succinimide (number-average molecular weight of polybutenyl group: 1000)

[13)]alkyl phosphite

[14)]calcium sulfonate (base number (perchloric acid method): 300 mg KOH/g)

[15)]containing dispersant, friction modifier, seal swelling agent, and anti-oxidant As indicated in Table 1, it is appreciated that the transmission lubricating oil compositions containing Component (B1) and fulfilling Requirement [I] according to the present invention (Examples 1 to 7) are excellent in fatigue life though low in viscosity. In particular, the compositions containing a polymethacrylate having a weight-average molecular weight of 15000 to 60000, as Component (B1) are more excellent in fatigue life (from comparison between Examples 1 and 6, and Examples 4 and 7). It is also appreciated that the use of Component (A2b) in combination as Component (A2) results in an improvement in fatigue life (from comparison Example 4 and Examples 1 to 3 and 5, and comparison between Example 7 and 6).

On the other hand, the compositions containing a polymethacrylate-based additive containing substantially no methacrylate of 16 or more carbon atoms as a structural unit instead of Component (B1) and containing no Component (A2) (Comparative Examples 1 to 3) were all poor in fatigue life (from comparison with Examples 1 and 6).

As indicated in Table 2, it is appreciated that the transmission lubricating oil compositions containing Component (B2), and Components (A1) and (A2) in combination and fulfilling Requirement [II] according to the present invention (Examples 8 to 10) are excellent in fatigue life though low in viscosity. In particular, the compositions with optimized Component (A), containing a polymethacrylate having a weight average molecular weight of 15000 to 60000, as Component (B) are more excellent in fatigue life, low temperature viscosity characteristics and/or an ability to suppressing the acid number from increasing (from comparison between Example 8 and Examples 9 and 10).

On the other hand, the compositions containing Component (B2) but not Component (A2) as Component (A) (Comparative Examples 4 to 6) were all poor in fatigue life. A composition containing no Component (A1) can not be expected to improve the fuel efficiency of the automobile because it is difficult to adjust the kinematic viscosity at 100° C. to 3 to 8 $mm^2/s$.

As indicated in Table 3, it is appreciated that the compositions containing Component (B3) and fulfilling Requirement [III] wherein the ratio of the kinematic viscosity at 100° C. of (A) a lubricating base oil (Vb) to the kinematic viscosity at 100° C. of the transmission lubricating oil composition (Vc), i.e., Vb/Vc is 0.70 or greater (Examples 11 to 13) were excellent in fatigue life and extreme pressure properties though low in viscosity. In particular, it is appreciated that the composition containing Component (A2b) as Component (A) (Example 13) is further improved in fatigue life while the composition containing Components (B3) and (B4) in combination but not Component (A2b) (Example 12) is excellent in both fatigue life and low temperature viscosity characteristics.

On the other hand, it is appreciated that the composition containing no Component (B3) (Comparative Example 7) and the compositions each having a Vb/Vc of less than 0.70 (Comparative Examples 8 and 9) are all poor in any of the advantageous effects achieved by the present invention.

As indicated in Table 4, it is appreciated that the compositions containing Components (A) to (D) and in particular a polymethacrylate-based additive having a weight-average molecular weight of 15000 to 60000 (Examples 14 to 20) are excellent in fatigue life, anti-shudder durability, and oxidation stability.

What is claimed is:

1. A lubricating oil composition for transmissions consisting essentially of components (A), (B), (C) and (D), wherein (A) is a lubricating base oil with a kinematic viscosity at 100° C. adjusted to 1.5 to 6 $mm^2/s$, composed of (A1) and (A2), wherein (A1) is a lubricating base oil with a kinematic viscosity at 100° C. of 1.5 $mm^2/s$ or higher and lower than 7 $mm^2/s$ comprising one or more mineral base oils selected from (Ala) a mineral base oil with a kinematic viscosity at 100° C. of 1.5 $mm^2/s$ or higher and lower than 3.5 $mm^2/s$ and (A1b) a mineral base oil with a kinematic viscosity at 100° C. of 3.5 $mm^2/s$ or higher and lower than 7 $mm^2/s$;

(A2) is a lubricating base oil with a kinematic viscosity at 100° C. of 7 to 50 $mm^2/s$ comprising one or more mineral base oils selected from (A2b) a lubricating base oil with a kinematic viscosity at 100° C. of 21.5 $mm^2/s$ or higher and lower than 25 $mm^2/s$ and (A2c) a lubricating base oil with a kinematic viscosity at 100° C. of 25 to 50 $mm^2/s$;

(B) is a poly(meth)acrylate-based additive containing a structural unit represented by formula (1) and having a weight-average molecular weight of 60,000 to 300,000, so that the composition has a kinematic viscosity at 100° C. of 3 to 8 $mm^2/s$ and a viscosity index of 95 to 200, (1)

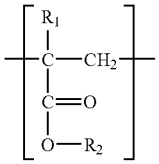

wherein $R_1$ is hydrogen or methyl, $R_2$ is a hydrocarbon group having 5 to 20 carbon atoms or a group represented by —$(R)_a$-E wherein R is an alkylene group having 5 to 20 carbon atoms, E is an amine residue or a heterocyclic residue, each having 1 or 2 nitrogen atoms and 0 to 2 oxygen atoms, and a is an integer of 0 or 1;

(C) is an imide-based friction modifier represented by formula (3) and/or a derivative thereof in an amount of 1 to 5 percent by mas based on the total amount of the composition, (3)

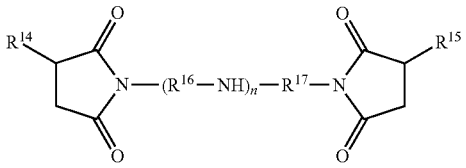

wherein $R^{14}$ and $R^{15}$ are each independently a straight-chain or branched hydrocarbon group having 8 to 30 carbon atoms, $R^{16}$ and $R^{17}$ are each independently a hydrocarbon group having 1 to 4 carbon atoms, and n is an integer of 1 to 7; and (D) is a sulfur-free phosphorus-based extreme pressure additive.

2. The lubricating oil composition according to claim 1, wherein Component (A1) further comprises (A1c) a polyolefin base oil with a kinematic viscosity at 100° C. of 1.5 $mm^2/s$ or higher and lower than 7 $mm^2/s$, and/or Component (A2) further comprises (A2a) a lubricating base oil with a kinematic viscosity at 100° C. of 7 $mm^2/s$ or higher and lower than 15 $mm^2/s$.

3. The lubricating oil composition according to claim 1, wherein (B) further comprises a poly(meth)acrylate containing a structural unit of formula (1) wherein $R_1$ is hydrogen or methyl and $R_2$ is methyl.

4. The lubricating oil composition according to claim 1, further consisting essentially of at least one type of additive selected from metallic detergents, dispersants, extreme pressure additives, seal swelling agents, anti-oxidants, and pour point depressants.

5. The lubricating oil composition according to claim 1, wherein (D) is contained in an amount of 0.015 to 0.05 percent by mass in terms of phosphorus on the basis of the total amount of the composition.

6. The lubricating oil composition according to claim 1, wherein Component (A) is composed of 70 to 97 percent by mass of Component (A1) and 3 to 30 percent by mass of Component (A2).

7. The lubricating oil composition according to claim 1, wherein Component (B) is a poly(meth)acrylate copolymer of a mixture of (meth)acrylates having a straight-chain alkyl group of 12 to 15 carbon atoms and a mixture of a monomer mainly composed of a (meth)acrylate having a straight-chain alkyl group of 16 carbon atoms and a (meth)acrylate having a straight-chain alkyl group of 18 carbon atoms.

8. The lubricating oil composition according to claim 1, wherein a ratio (Mw/Mn) of a weight-average molecular weight (Mw) to a number-average molecular weight (Mn) is from 2 to 3.5.

9. The lubricating oil composition according to claim 1, wherein the composition fulfills requirement [III]:

[III] the kinematic viscosity at 100° C. (Vc) of the composition is from 4.5 to 8 $mm^2/s$, and the ratio of the kinematic viscosity at 100° C. (Vb) of Component (A) to (Vc) (=Vb/Vc) is 0.70 or greater.

10. The lubricating oil composition according to claim 1, wherein (D) the sulfur-free phosphorus-based extreme pressure additive is a phosphoric acid ester and/or a phosphorous acid ester having 3 to 30 carbon atoms.

11. The lubricating oil composition according to claim 1, wherein (B) further comprises a poly(meth)acrylate containing a structural unit of formula (1) wherein $R_1$ is hydrogen or methyl and $R_2$ is a branched alkyl group having 20 to 30 carbon atoms.

* * * * *